US005909786A

United States Patent [19]

Anthony

[11] Patent Number: 5,909,786

[45] Date of Patent: Jun. 8, 1999

[54] APPARATUS AND METHOD FOR REDUCING FIBER WASTE BY LINT CLEANERS

[75] Inventor: William Stanley Anthony, Greenville, Miss.

[73] Assignee: The United States of America as represented by the United States Department of Agriculture, Washington, D.C.

[21] Appl. No.: 09/107,799

[22] Filed: Jun. 30, 1998

[51] Int. Cl.[6] ..... D01B 1/04

[52] U.S. Cl. ..... 19/41; 19/39; 19/40; 19/48 R

[58] Field of Search ..... 19/41, 39, 40, 19/44, 48 R, 50, 54, 55 R, 58, 59, 61, 62 R, 55 A, 64.5, 107, 108, 113, 51; 241/242

[56] References Cited

U.S. PATENT DOCUMENTS 2,810,163 10/1957 Kyame et al. ..... 19/48 R
4,654,933 4/1987 Horn et al. ..... 19/39
5,295,283 3/1994 Gillum et al. ..... 19/55 R
5,697,126 12/1997 Baker, Jr. ..... 19/39

*Primary Examiner*—John J. Calvert
*Assistant Examiner*—Gary L. Welch
*Attorney, Agent, or Firm*—Townsend and Townsend and Crew LLP

[57] ABSTRACT

An apparatus for cleaning cotton having a frame which rotatably supports a cylinder member having a cylindrical surface supporting a fiber-engaging structure for seizing contaminated cotton. The frame supports a grid assembly which assists in the removal of undesirable particulates from contaminated cotton engaged to the fiber-engaging structure of the cylinder member. The grid assembly includes a plurality of grid bars connected to the frame in a spatial relationship such that any two contiguous grid bars are separated by a grid space. A shroud member is supported by the frame for controlling the loss of cotton fiber through the grid space between two contiguous grid bars. A method of controlling and/or reducing the loss of cotton during lint cleaning of contaminated cotton. A method for retrofitting a lint cleaner to modify the lint-cleaning ability of the lint cleaner.

26 Claims, 20 Drawing Sheets

Automated Super Lint Savers

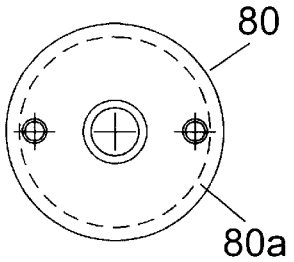
FIG. 14
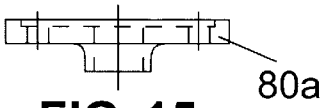
FIG. 15
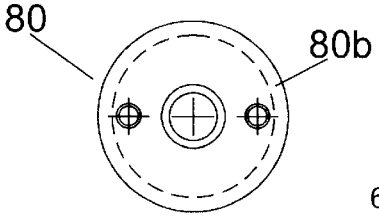
FIG. 19
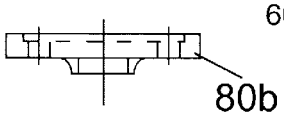
FIG. 18
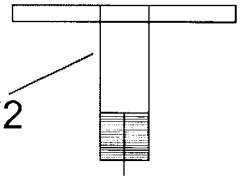
FIG. 20A
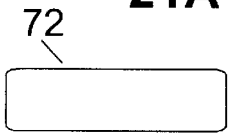
FIG. 20B
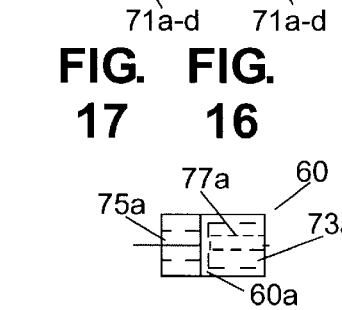
FIG. 17 FIG. 16
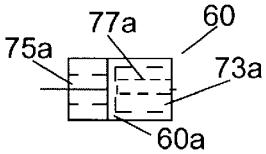
FIG. 21C
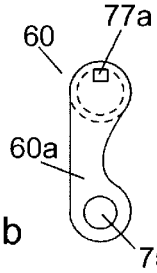
FIG. 21A
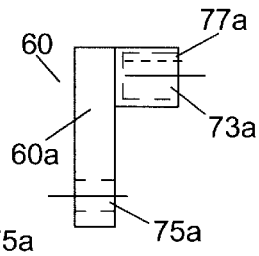
FIG. 21B
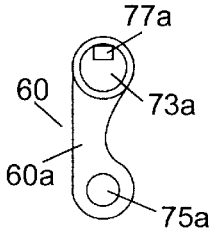
FIG. 21D
FIG. 12
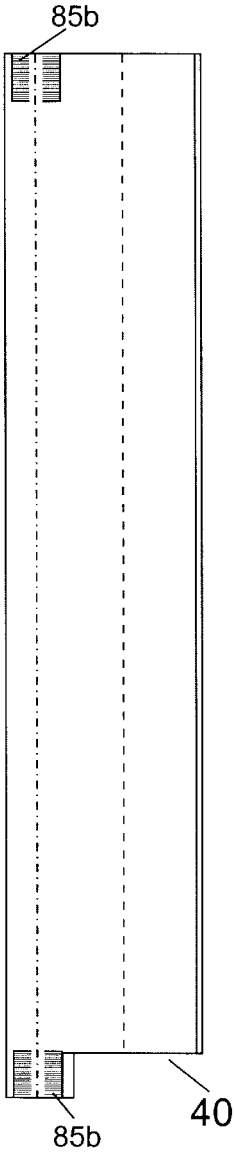
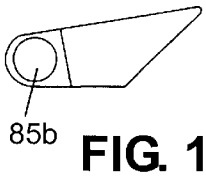
FIG. 13

APPARATUS AND METHOD FOR REDUCING FIBER WASTE BY LINT CLEANERS

BACKGROUND OF THE INVENTION

1. Field of the Invention

The present invention relates to extracting and cleaning cotton. More specifically, the present invention provides an apparatus and method for reducing cotton fiber waste by lint cleaners.

2. Description of the Prior Art

Over 80 million bales of cotton are produced annually in the world. These cottons are harvested by hand or mechanically by machines called spindle-harvesters or cotton strippers. Depending upon the harvesting method, these cottons are precleaned through various machines in a cotton-gin processing plant and dried prior to the fiber being separated from the seed. After the fiber is separated from the seed, it is further cleaned by different types of machines that are typically called lint cleaners. Lint cleaners were developed specifically for removing leaf particles, motes, grass, and bark that remain in cotton after seed cotton cleaning, extracting, and ginning. They were developed and improved in conjunction with the transition from manual to mechanized harvesting of cotton in the United States during the 1950's. Virtually all gins in the United States have lint-cleaning facilities, and over four-fifths of the gins have two or more stages of lint cleaning.

The most common lint cleaner in the ginning industry is called a saw-type lint cleaner which removes 15 to 30 pounds of material per bale, with much of this material being usable fiber. In terms of principles of operation, a thin batt of cotton fiber is fed mechanically onto a cylinder wound with fine-tooth saws. The saws grasp the cotton fiber and pull it between the saw cylinder and a set of closely spaced (0.06 to 0.12 inches) cleaning points commonly called grid bars. Saw-type lint cleaners typically have 5 to 8 grid bars each. Each grid bar location creates a cleaning point that separates and ejects cotton fiber and foreign matter from the saw toothed-engaged cotton. The first grid bar separates and ejects a high percentage of foreign matter and a low percentage of cotton fiber. The percentage of foreign matter separated and ejected decreases dramatically and the percentage of cotton fiber separated and ejected increases dramatically as the number of grid bars increase. For example in a 5-grid bar machine, about 25, 23, 22, 15, and 15% by weight of the foreign material is separated and ejected by the first, second, third, fourth and fifth grid bars, respectively. Therefore, as the saw toothed-engaged cotton fiber progresses successively against and under grid bars, decreasing amounts of foreign matter and increasing amounts of cotton fiber are removed concomitant with an increase in damage to the saw toothed-engaged cotton. Furthermore, cotton fiber is separated from the saw toothed-engaged cotton and ejected, even if no foreign matter is present. Thus, substantial money is lost.

About 20% of all cotton processed today in the United States requires only a portion of cleaning available from conventional saw-type lint cleaners. Thus, some cotton is over-processed and a substantial amount of cotton fiber is lost. A primary reason for such a substantial amount of cotton lost is that conventional saw-type lint cleaners typically have too many grid bars, for example 5 to 8 grid bars.

Some cottons obviously contain far more foreign matter than others. Therefore, certain cottons would require the use of all available grid bars in addition to perhaps another lint cleaner. Depending upon the foreign matter or color, as little as one grid bar or as many as five or more grid bars per machine and as many as three machines may be required to meet market demands. There is currently no technology available which would permit use of less than all of the grid bars available for any particular lint cleaning machine. If an apparatus and method were available that would allow the selection of less than the total number of grid bars available, the amount of cotton fiber lost would be reduced. Thus, only the required number of grid bars needed for any particular cotton would be employed, and the cost and waste of cotton fiber would be substantially reduced, especially for relatively clean cotton which requires only one or two grid bars. If a cotton processor possessed the ability to use or not use each individual grid bar, fiber wastage could be decreased by 5 to 15 pounds per bale.

Therefore, what is needed and what has been invented is an apparatus and a method for reducing the loss and waste of cotton fiber as cotton is being processed through a lint cleaner. What is further needed and what has been invented is an apparatus and a method that allow prescription processing of cotton through a lint cleaner based upon its requirements, rather than processing the cotton through the entire lint cleaner regardless of its needs.

SUMMARY OF THE INVENTION

The present invention accomplishes its desired objects by broadly providing an apparatus (e.g., a saw lint cleaner) for cleaning cotton. The apparatus includes a frame, a cylinder member (e.g., a saw cylinder) rotatably supported by the frame and having a cylindrical surface supporting a fiber-engaging structure (e.g., toothed wire or saw teeth), and a motor coupled to the cylinder member. A grid assembly is connected to the frame for assisting in the removal of undesirable particulates from cotton engaged to the fiber-engaging structure of the cylinder member. The grid assembly comprises a plurality of grid bars connected to the frame in a spatial relationship such that any two contiguous grid bars are separated by a grid space. A shroud member is supported by the frame for controlling the loss of cotton through the grid space between contiguous grid bars. Each of the contiguous grid bars has a cleaning edge (i.e., a cotton cleaning structure) for contacting cotton engaged to the fiber-engaging structure of the cylinder member, and the shroud member covers the cleaning edge of one of the contiguous grid bars to prevent the cleaning edge from contacting the cotton engaged to the fiber-engaging structure of the cylinder member. The shroud member may be coupled to the contiguous grid bars or it may be pivotally attached to the frame in the grid space between the contiguous grid bars such as to be capable of covering and opening the grid space for controlling the loss of cotton. The shroud member may include a shroud tongue that is capable of being removably aligned with a grid shoulder of one of the contiguous grid bars. The shroud member may also include a generally arcuate surface, preferably a generally arcuate surface which is, or is capable of being, generally arcuately aligned with the plurality of grid bars.

The present invention also accomplishes its desired objects by further broadly providing a method of controlling and/or reducing the loss of cotton during lint cleaning of contaminated cotton. The method comprises the steps of:

(a) providing a grid assembly including a plurality of spaced grid bars wherein any two contiguous spaced grid bars are separated by a grid space;

(b) seizing contaminated cotton with a fiber engaging structure of a cylinder member disposed in proximity to the grid assembly of step (a);

(c) revolving the cylinder member of step (b) such that the contaminated cotton is capable of impactly contacting a cotton-cleaning structure of each grid bar for assisting in the cleaning of the contaminated cotton and causing cotton fiber to separate from the contaminated cotton; and (d) preventing the contaminated cotton from impactly contacting the cotton-cleaning structure of one of the spaced grid bars for reducing the amount of cotton fiber separating from the contaminated cotton.

In the immediate foregoing method, preventing the contaminated cotton from contacting the cotton-cleaning structure may be accomplished by any one of the following steps: (i) covering the cotton-cleaning structure of one of the spaced grid bars; (ii) contacting the cotton-cleaning structure of one of the spaced grid bars with a shroud member; (iii) disposing a shroud member in the grid space juxtaposed to the cotton-cleaning structure of one of the spaced grid bars; or (iv) pivoting a shroud member in the grid space juxtaposed to the cotton-cleaning structure of one of the spaced grid bars. The method may additionally comprise aligning a grid shoulder of one of the grid bars with a shroud tongue of the shroud member.

The present invention further also accomplishes its desired objects by also further broadly providing a method for modifying the lint-cleaning ability of a lint cleaner comprising the steps of:

(a) providing a cotton-engaging cylinder member rotatably disposed in proximity to a grid assembly having a plurality of spaced grid bars wherein each grid bar is a cleaning point for cotton revolvably engaged to the cotton-engaging cylinder member; and (b) replacing at least one of the spaced grid bars with a shroud member in order to remove at least one of the cleaning points for the cotton of step (a).

It is therefore an object of the present invention to provide an apparatus for cleaning cotton.

It is another object of the present invention to provide a method of controlling and/or reducing the loss of cotton during lint cleaning of contaminated cotton.

It is yet another object of the present invention to provide a method for modifying the lint-cleaning ability of a lint cleaner.

These, together with the various ancillary objects and features which will become apparent to those skilled in the art as the following description proceeds, are attained by these novel apparatuses and methods, a preferred embodiment thereof shown with reference to the accompanying drawings, by way of example only, wherein:

BRIEF DESCRIPTION OF THE DRAWINGS

FIG. 12 is a front elevational view of another embodiment of the shroud member;

FIG. 13 is an end elevational view of the shroud member of FIG. 12;

FIG. 14 is an end elevational view of a cylindrical support bushing for assembling a pivotally disposed shroud member;

FIG. 15 is a side elevational view of the cylindrical support bushing of FIG. 14;

FIG. 16 is a side elevational view of a cylindrical support pin for threadably engaging a threaded bore of the shroud member of FIG. 12;

FIG. 17 is a side elevational view of another cylindrical support pin for threadably engaging another threaded bore of the shroud member of FIG. 12;

FIG. 18 is a side elevational view of another cylindrical support bushing for assembling a pivotally disposed shroud member;

FIG. 19 is an end elevational view of the cylindrical support bushing of FIG. 18;

FIG. 20A is a side elevational view of a T-shaped support pin for threadably coupling to the shroud member of FIG. 12;

FIG. 20B is an end elevational view of the T-shaped support pin of FIG. 20A;

FIG. 21A is a side elevational view of an arm member;

FIG. 21B is a front elevational view of the arm member in FIG. 21A;

FIG. 21C is a top plan view of the arm member in FIG. 21A;

FIG. 21D is a side elevational view of the arm member, opposite to the side elevational view of FIG. 21A;

DESCRIPTION OF THE PREFERRED EMBODIMENT

Figure 1:
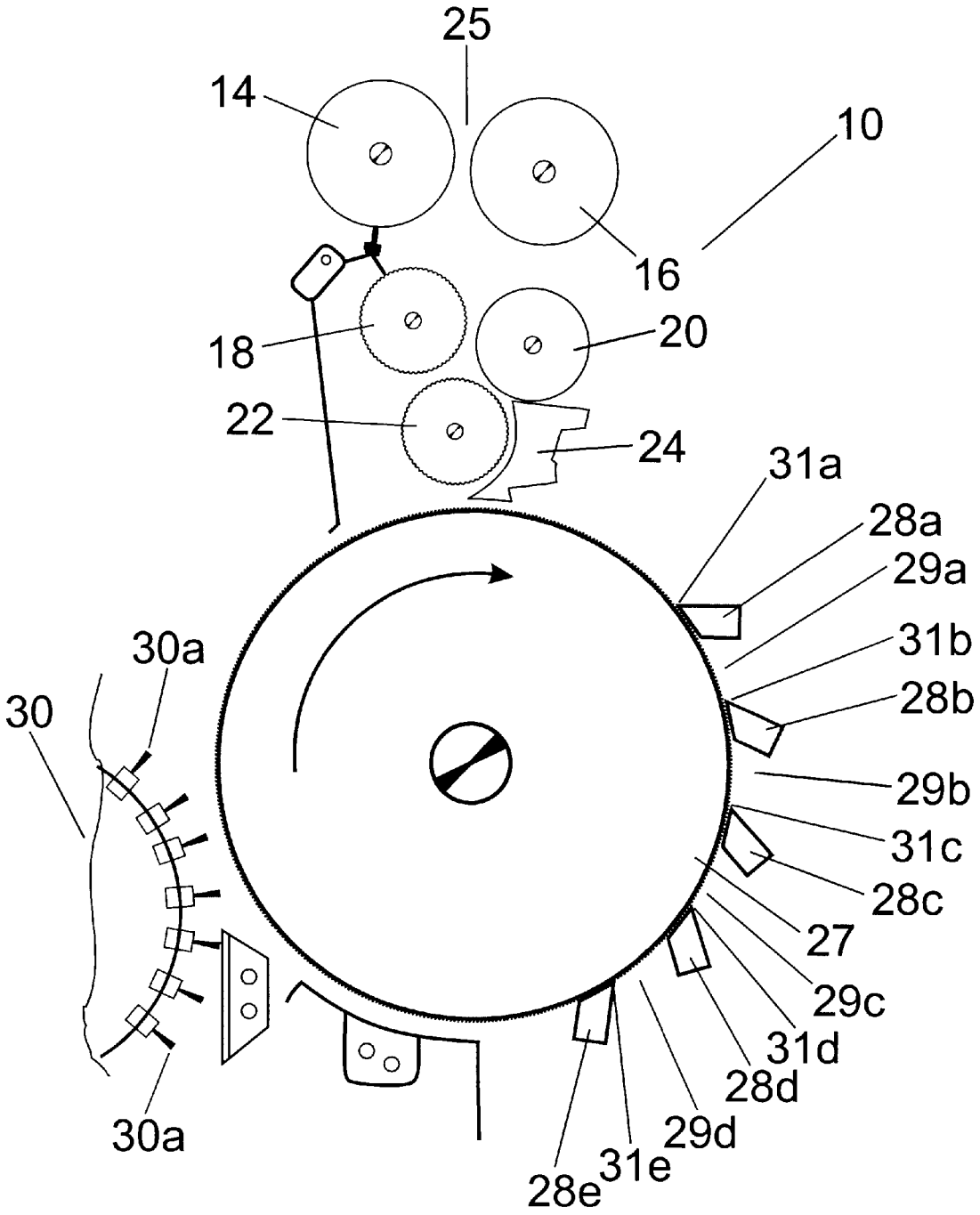
FIG. 1 is a schematic end elevational view of a prior art controlled-batt saw lint cleaner.

Referring in detail now to the drawings wherein similar parts of the inventions are identified by like reference numerals, there is seen in FIGS. 1–4 a prior art lint cleaner, generally illustrated as 10 in FIG. 1. Lint cleaner 10 comprises compression rollers 14, 16, 18 and 20, a feed roller 22, and a feed plate 24, all for feeding fibers of lint cotton 25 onto a saw cylinder 26. Feed plate 24 is formed with a toe 24*a*. Lint cleaner 10 also includes a grid assembly 28 for assisting in the cleaning of lint cotton 25. A doffing brush cylinder 30 is provided for removing cleaned lint cotton 25 from the saw cylinder 26. Grid assembly 28 includes a plurality of grid bars 28*a*, 28*b*, 28*c*, 28*d* and 28*e* having respective leading edges 31*a*, 31*b*, 31*c*, 31*d* and 31*e*, and separated by grid spaces, generally illustrated as 29. Respective pairs of grid bars 28*a*, and 28*b*, 28*b* and 28*c*, 28*c* and 28*d*, and 28*d* and 28*e* are respectively separated by grid spaces 29*a*, 29*b*, 29*c* and 29*d*. Doffing brush cylinder 30 has a plurality of bristles 30*a* which touch points of the saw cylinder 26 (see FIG. 1) for engaging and removing lint cotton 25 after it has been cleaned.

Saw cylinder 26 is covered with toothed wire (or saw teeth) 27 wound in a spiral from one end to the other end of the saw cylinder 26. Typically, there are eight spiral wraps of wire per inch of saw cylinder length. There are normally 5–6 teeth/linear inch of wire, creating a cylinder population of about 45 teeth/sq.in. Toothed wire 27 is needle sharp to properly comb cotton fibers from the batt.

Lint cleaners, such as lint cleaner 10, were developed specifically for removing leaf particles, immature seeds, motes, grass, and bark, collectively designated herein as foreign matter 7, that remains in lint cotton 25 after seed cotton cleaning, extracting, and ginning. In order to separate foreign matter 7 from lint cotton 25, lint cotton 25 is initially formed into a batt on a condenser screen drum (not seen). The batt should be of uniform thickness and be evenly spread over the entire width of the lint cleaner 10; otherwise, poor cleaning and excessive fiber loss will result. After the batt is formed, it is then initially fed through compression rollers 14, 16, 18 and 20 and subsequently passed between the very closely fitted feed roller 22 and feed plate 24 and fed onto the saw cylinder 26. Stated alternatively and more specifically, after the batt of lint cotton 25 passes through the narrow gap between the feed roller 22 and the feed plate 24, it then reverses direction around the toe 24*a* of the feed plate 24 to move on the toothed wire 27 of the saw cylinder 26. The feed plate 24 generally clears the toothed wire 27 by about one-sixteenth inch. The feed roller 22 is preferably fluted and under spring tension, exerting pressure toward the feed plate 24 and holding the batt of lint cotton 25 while it is combed and fed onto the toothed wire 27 of saw cylinder 26.

After the lint cotton 25 has been engaged by the tooth wire 27, it is carried against and under the grid bars 28*a*, 28*b*, 28*c*, 28*d* and 28*e* of the grid assembly 28 for removing foreign matter 7. The leading edges 31*a*, 31*b*, 31*c*, 31*d* and 31*e* function as cleaning edges or points and are preferably sharp to avoid reducing cleaning efficiency and increasing the loss of lint cotton, which is designated herein as loss lint cotton 25*a* after being separated from lint cotton 25. Thus, each of the leading edges 31*a*, 31*b*, 31*c*, 31*d* and 31*e* contacts the lint cotton 25 and separates or breaks free foreign matter 7, as well as loss lint cotton 25*a*, from lint cotton 25. It is to be understood that while the lint cotton 25 is engaged to the toothed wire 27 on the saw cylinder 26, it is cleaned not only by scrubbing action between the saw cylinder 26 and the grid bars (i.e. grid bars 28*a*, 28*b*, etc.) of the grid assembly 28, but also by centrifugal force and gravity which is assisted by air currents.

Figure 2:
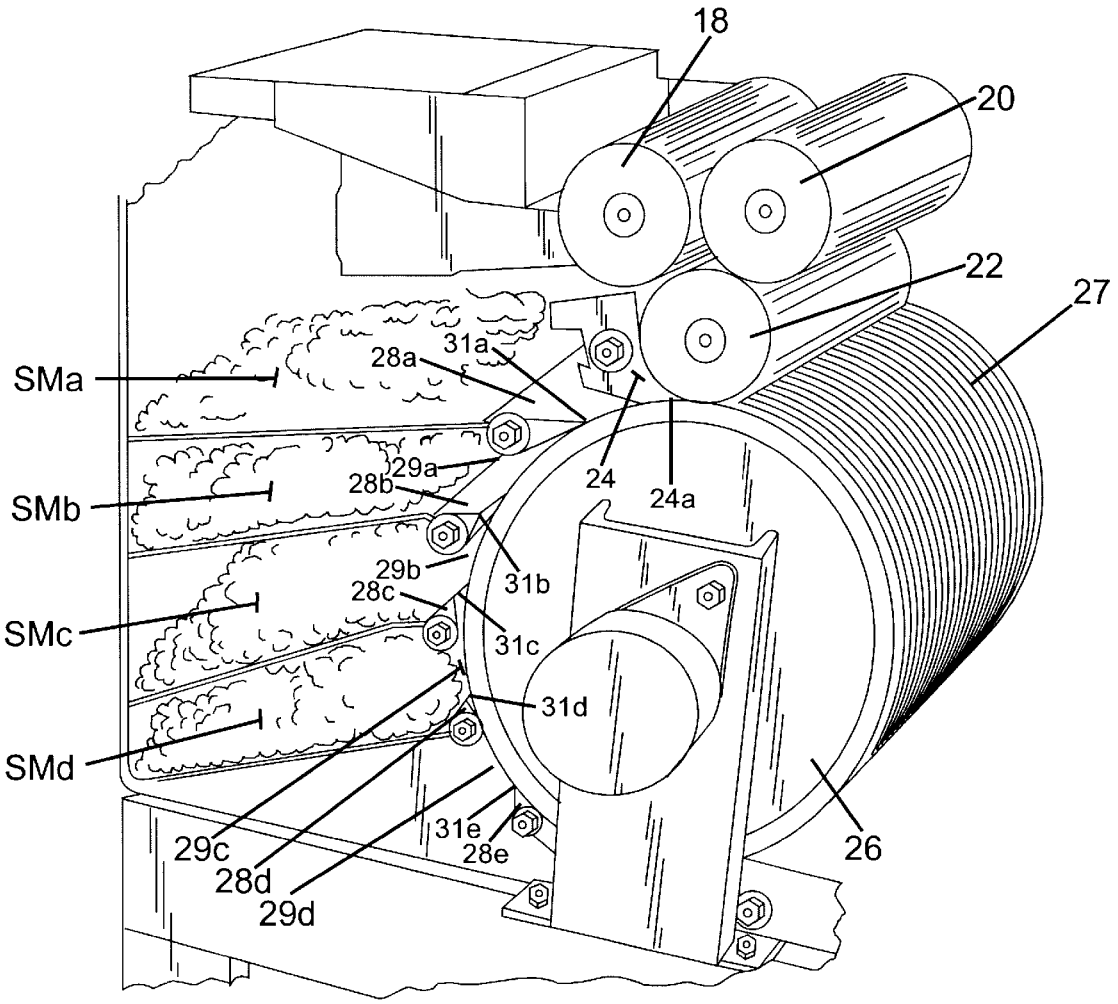
FIG. 2 is a perspective view of a prior art saw cylinder after having separated foreign material and cotton fibers.
Figure 3:
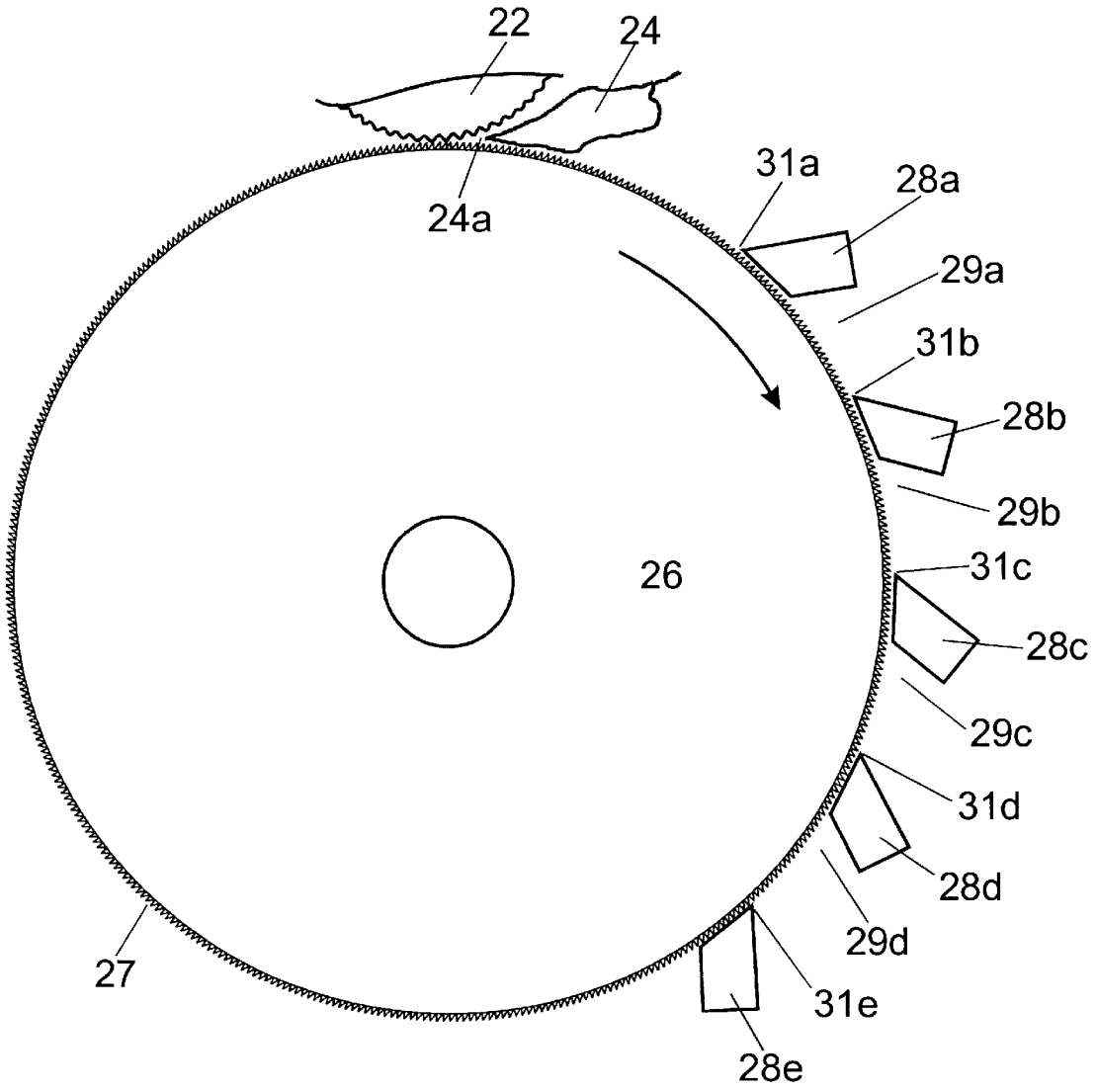
FIG. 3 is an end elevational view of the saw cylinder in FIG. 1 illustrating the position of the grid bars with respect to the saw cylinder.
Figure 4:
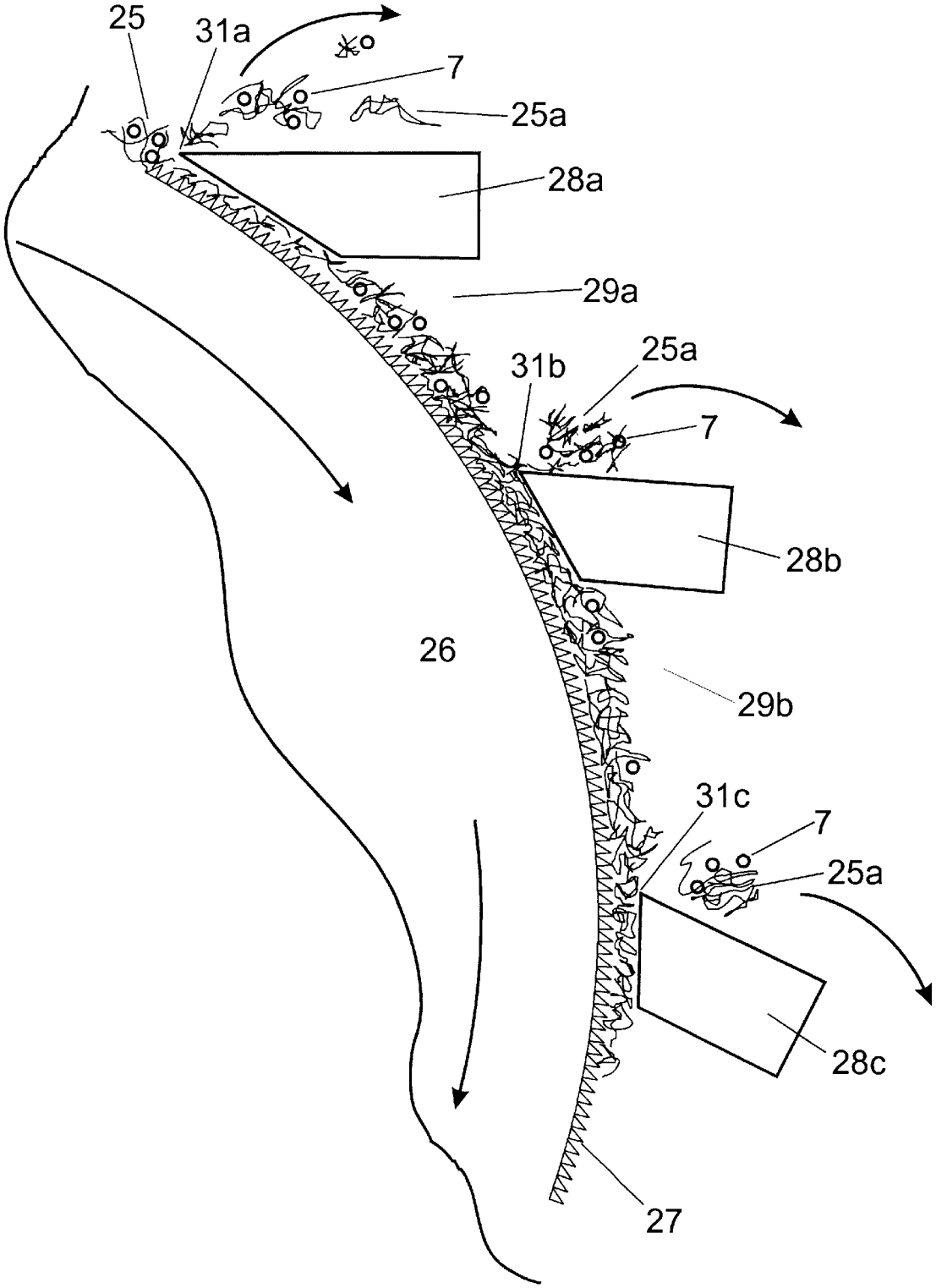
FIG. 4 is a partial enlarged end elevational view of a rotating saw cylinder having contaminated cotton engaged to its associated saw teeth and rotating past a plurality of grid bars such that the respective cleaning edges of the grid bars contact the engaged contaminated cotton, causing undesirable particulates and cotton fiber to be separated therefrom.
Figure 5:
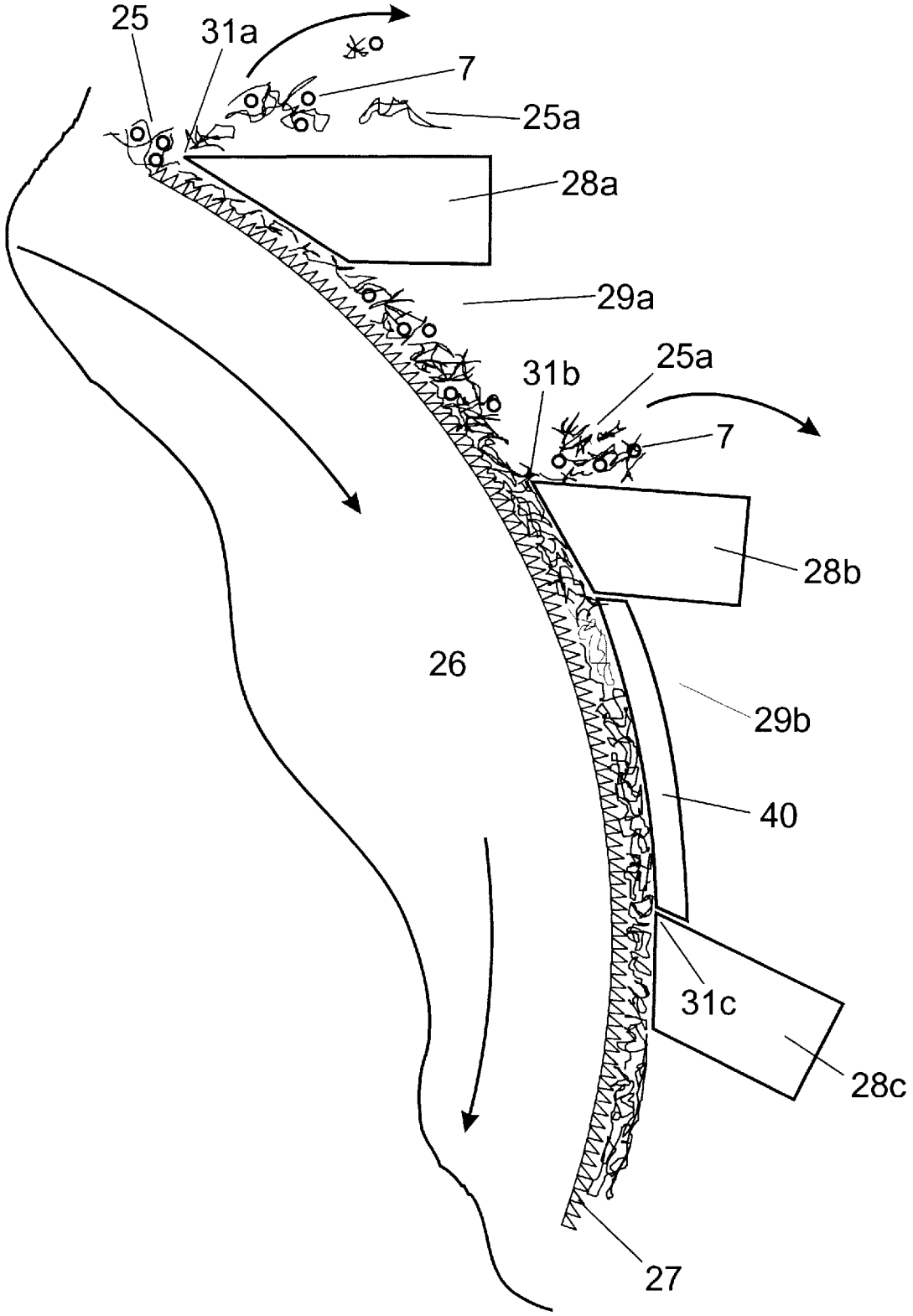
FIG. 5 is an end elevational view of the saw cylinder of FIG. 4 after a shroud member has been disposed between two spaced contiguous grid bars for preventing the cleaning edge of one of the grid bars from contacting the engaged cotton and preventing the separation of cotton fiber from the engaged cotton.

Leading edge 31*a* of grid bar 28*a* contacts and separates from the lint cotton 25 a high percentage of foreign matter 7 and a low percentage of loss lint cotton 25*a*. As the lint cotton 25 is continually revolved by the saw cylinder 26, it successively contacts the respective leading edges 31*b*, 31*c*, 31*d* and 31*e* of grid bars 28*b*, 28*c*, 28*d* and 28*e*, causing the percentage of foreign matter 7 separated and ejected to decrease, and the percentage of loss lint cotton 25*a* separated and ejected to increase, as the lint cotton 25 processes successively against and under respective grid bars 28*b*, 28*c*, 28*d* and 28*e*. Thus, the mixture of foreign matter 7 and loss lint cotton 25*a* passing through grid space 29*a* generally contains a higher percentage of foreign matter 7 and a lower percentage of loss lint cotton 25*a* than the mixture of foreign matter 7 and loss lint cotton 25*a* passing through grid space 29*b*. Stated alternatively, there is a higher percentage of loss lint cotton 25*a* and a lower percentage of foreign matter 7 passing through grid space 29*b* than through grid space 29*a*. By way of illustration only, there is seen in FIG. 2 separated materials SMa, SMb, SMc and SMd which were produced from the lint cotton 25 contacting the respective leading edges 31*a*, 31*b*, 31*c*, and 31*d* of the grid bars 28*a*, 28*b*, 28*c* and 28*d*. The percentage of loss lint cotton 25*a* in respective separated materials SMa, SMb, SMc and SMd increases from separated material SMa to separated material SMb, from separated material SMb to separated material SMc, and from separated material SMc to separated material SMd. The percentage of foreign matter 7 would decrease from separated material SMa to separated material SMb, from separated material SMb to separated material SMc, and from separated material SMc to separated material SMd.

Depending on the initial cleanliness of lint cotton 25, by the time lint cotton 25 contacts leading 31*e* of grid bar 28*e*, the matter to be separated from the lint cotton 25 could be essentially all loss lint cotton 25*a* with minimal, if any, foreign matter 7 remaining and/or available for separation and ejection. Thus, the lint cleaner 10 would overclean the lint cotton 25, resulting in an unnecessary loss of cotton fibers and possibly fiber damage to the remaining lint cotton 25, which subsequently would be removed from the toothed wire 27 of the saw cylinder 26 by the bristles 30*a* of the doffing brush cylinder 30.

In order to prevent the removal of unnecessary loss lint cotton 25*a* from the lint cotton 25, a shroud member, generally illustrated as 40, is employed. The shroud member 40 may be any suitable structure manufactured from any suitable material (e.g., iron, aluminum, steel, plastic, etc.) which is capable of preventing and/or reducing and/or controlling the removal of unnecessary loss lint cotton 25*a* from the lint cotton 25. Preferably, there are three preferred embodiments for the shroud member 40; namely: the preferred embodiment for a semiautomatic-operative shroud member 40 as illustrated in FIGS. 6–8; the preferred embodiment for an automatic-operative shroud member 40 as illustrated in FIGS. 9A–26; and the preferred embodiment for a manually positioned shroud member 40 as illustrated in FIGS. 27–33.

Figure 6:
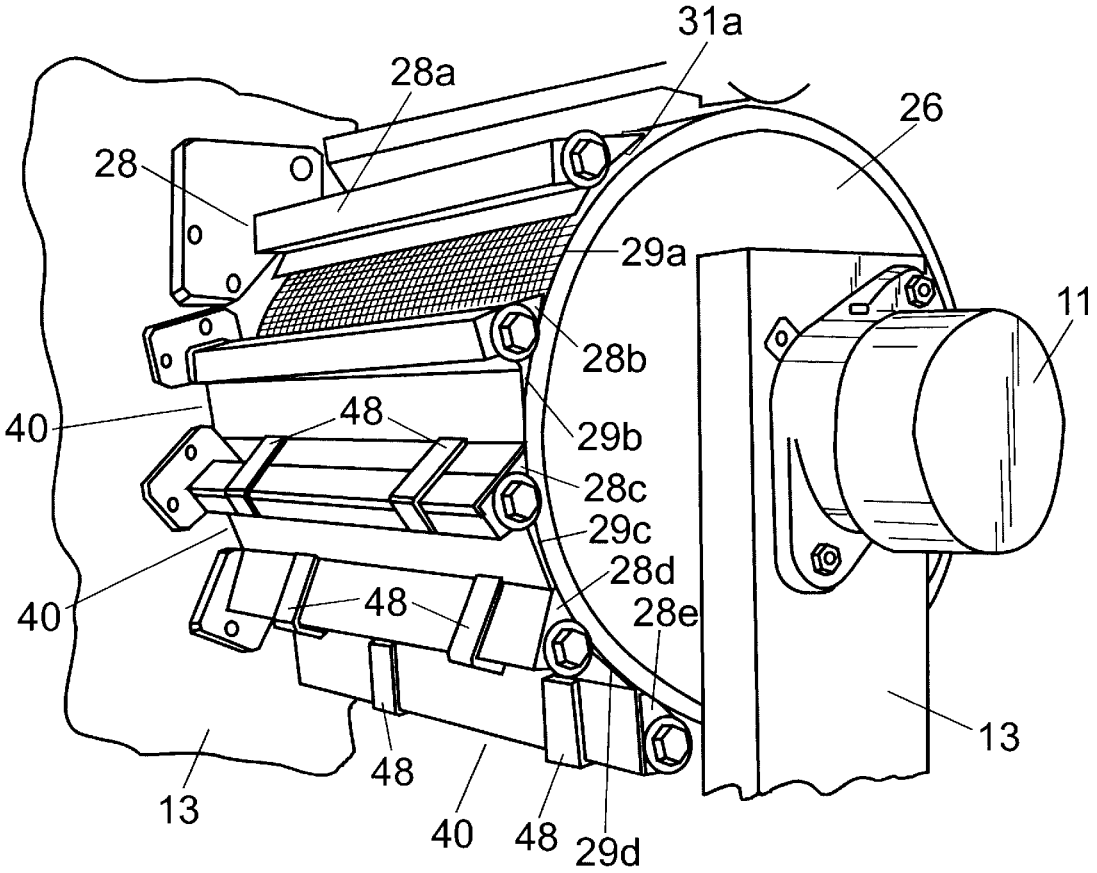
FIG. 6 is a perspective view of a saw cylinder having one embodiment of the shroud member engaged to contiguous spaced grid bars.
Figure 7:
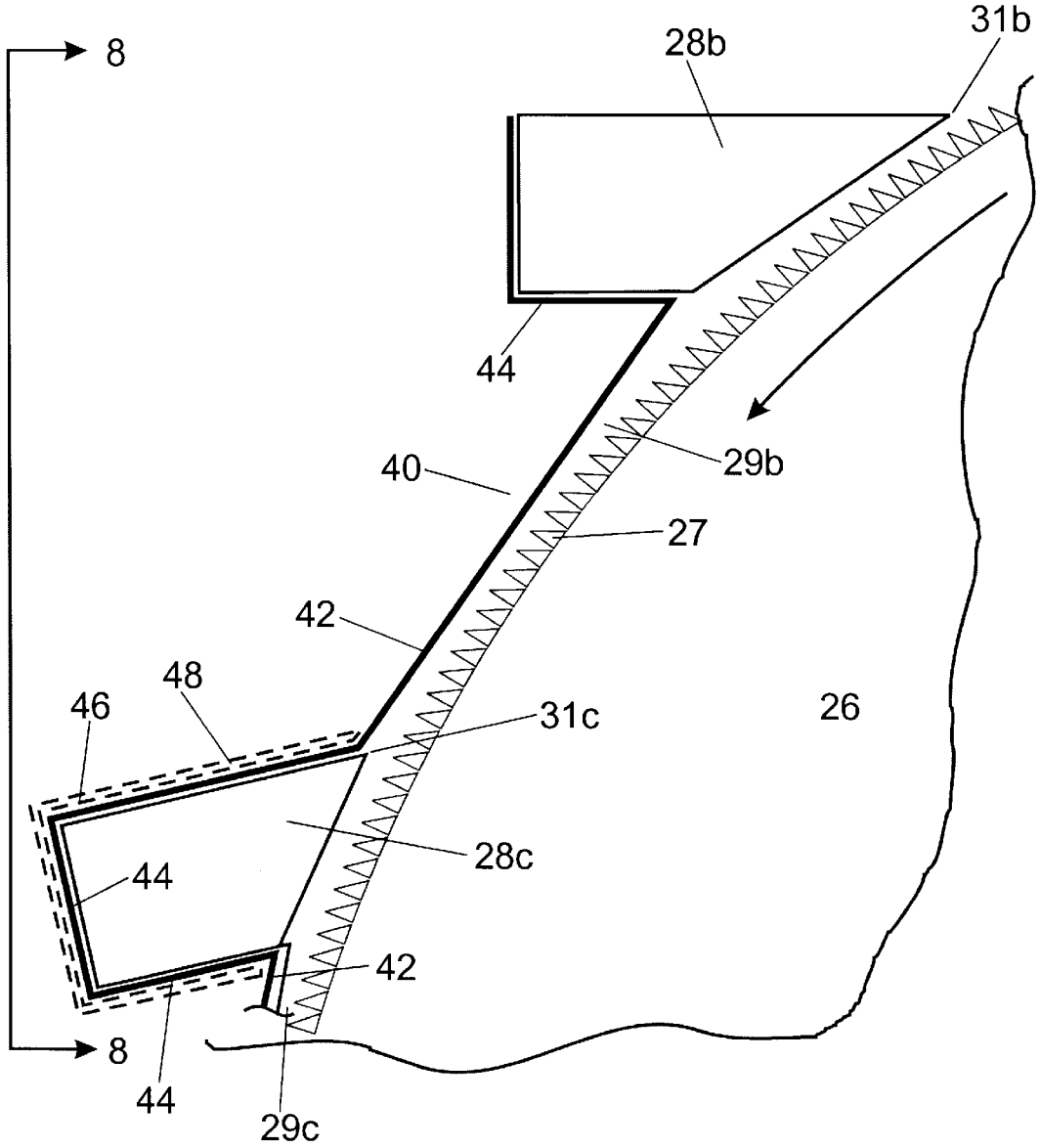
FIG. 7 is an enlarged end elevational view of two grid bars engaged to and supporting the embodiment of the shroud member of FIG. 6.
Figure 8:
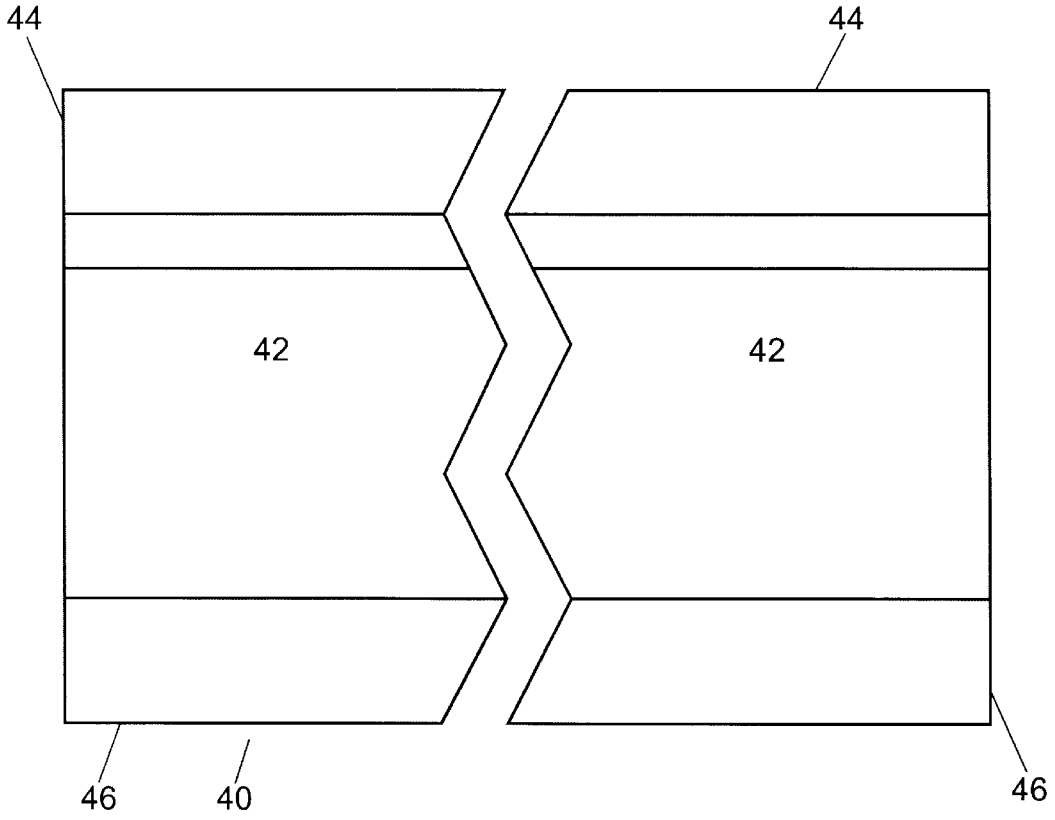
FIG. 8 is an elevational view of the shroud member of FIG. 7 taken in direction of the arrows and along the plane of line 8—8 in FIG. 7.

Referring now to FIGS. 6–8 for describing the preferred embodiment of the semiautomatic-operative shroud member 40, there is seen a frame assembly 13 rotatably supporting the saw cylinder 26. The frame assembly 13 also supports the grid assembly 28 (i.e., grid bars 28*a*, 28*b*, etc.) and a motor 11 which is coupled to the saw cylinder 26 for rotating or revolving the same. The shroud member 40 for this preferred embodiment of the invention is coupled to and supported by any pair of contiguous grid bars, such as grid bars 28*b* and 28*c* in FIG. 7.

In FIG. 6 there is seen three shroud members 40 respectively supported by contiguous pairs of spaced grid bars 28*b* and 28*c*, 28*c* and 28*d*, and 28*d* and 28*e*. This embodiment of the shroud member 40 includes an intermediate structure 42, and a pair of askewed ends 44 and 46 integrally bound to the intermediate structure 42. The intermediate structure 42 may be an arcuate structure, and the askewed ends 44 and 46 may be generally L-shaped to conform to the structure of the grid bars, as best shown by way of illustration only in FIG. 7 with respect to spaced grid bars 28*b* and 28*c*. Clamps 48 may be conveniently disposed over ends 44 and/or 46 for frictionally holding the shroud member 40 in an operative position, as best shown in FIGS. 6 and 7.

When the preferred embodiment of the shroud member 40 illustrated in FIGS. 6–8 is employed for preventing and/or reducing and/or controlling the removal of unnecessary loss lint cotton 25*a* from the lint cotton 25, the shroud member 40 functions to cover a leading edge (e.g., leading edges 31*b*, 31*c*, etc.) of a grid bar (e.g., grid bars 28*b*, 28*c*, etc.), as well as covering or blocking one of the grid spaces (e.g., grid spaces 29*a*, 29*b*, etc.). More specifically and as best shown in FIG. 7, there is seen the shroud member 40 as covering the leading edge 31*c* and the grid space 29*b* between contiguous spaced grid bars 28*b* and 28*c*. The intermediate structure 42 prevents the removal of unnecessary loss lint cotton 25*a* from the lint cotton 25 as a result of the centrifugal force from a rotating saw cylinder 26. The combination of the intermediate structure 42 and the askewed end 46 prevent the lint cotton 25 from engaging the leading edge 31*c* of the grid bar 28*c*. In the event that two or more of the shroud members 40 are employed, the shroud members 40 are positioned on the grid assembly 28 in an overlapping fashion. More specifically and as best shown in FIG. 7, askewed end 46 of the shown shroud member 40 overlaps the askewed end 44 of another shroud member 40. Clamp 48 may slip over the overlapping structures such as to engagedly contact askewed end 44 of one of the shroud members 40 and askewed end 46 of the shown shroud member 40. This preferred embodiment of the shroud member 40 may be manually disposed and removed from the grid assembly 28 and therefore there is no need to remove any of the grid bars (i.e., grid bars 28*a*, 28*b*, etc.) from the grid assembly 28. Also, no ancillary equipment is needed for operating this preferred embodiment of the shroud member 40 as illustrated in FIGS. 6–8.

Figure 9A:
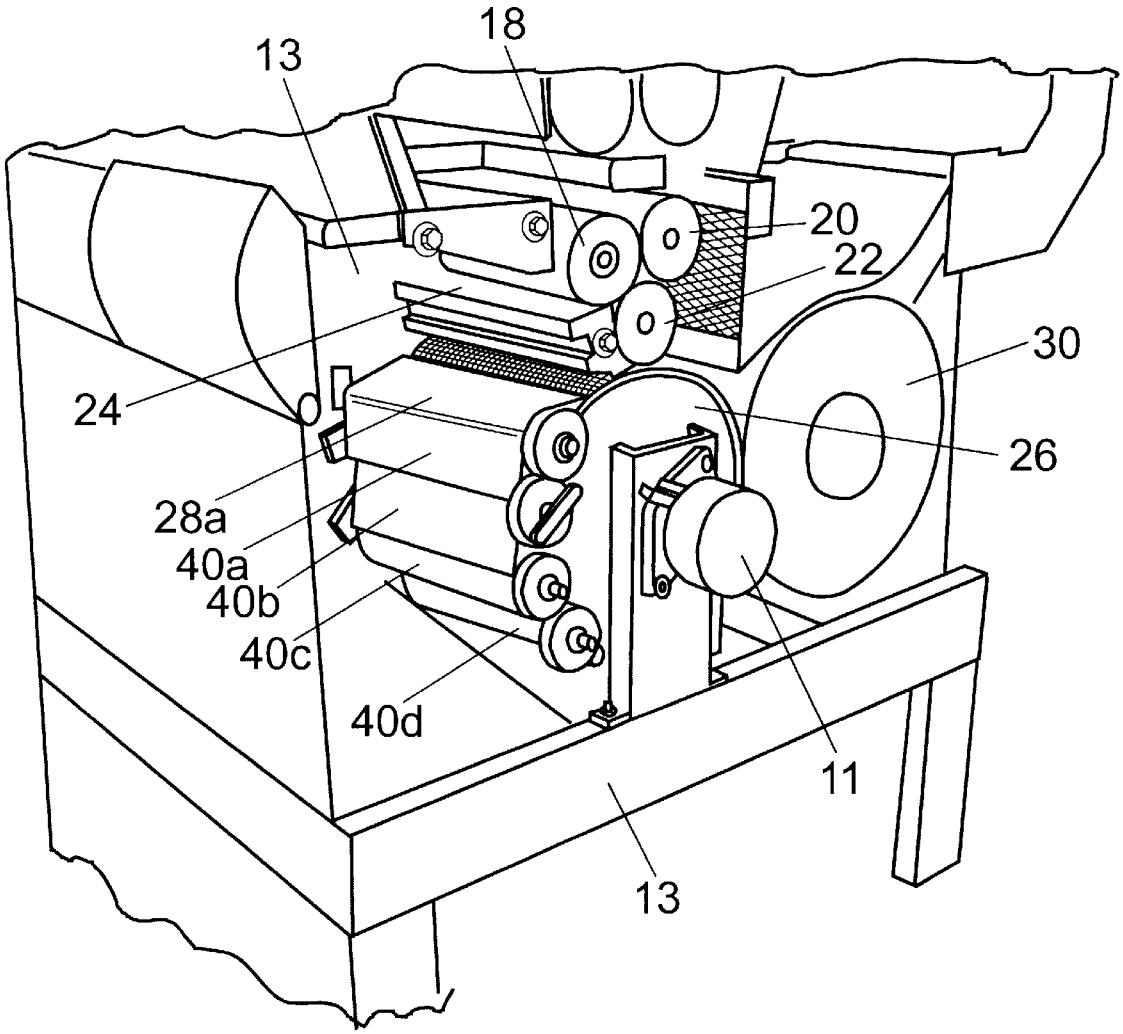
FIG. 9A is a perspective view of a saw cylinder and grid assembly and including a plurality of shroud members pivotally supported by a frame with a shroud member pivotally disposed in each grid space between any two contiguous grid bars.
Figure 9B:
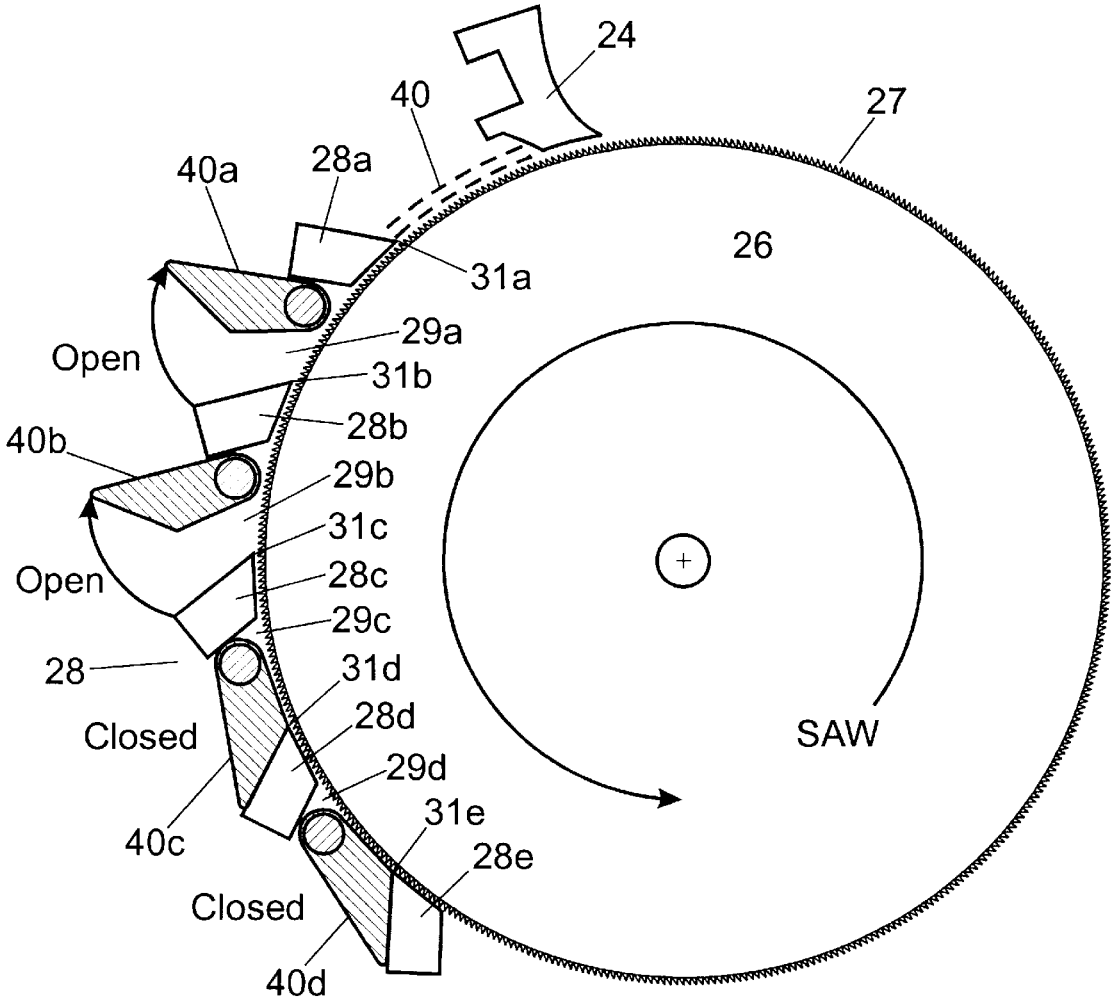
FIG. 9B is a schematic end elevational view of the saw cylinder and the grid assembly of FIG. 9A with a shroud member pivotally disposed in each grid space between any two contiguous bars.

Referring now to FIGS. 9A–26, there is seen the preferred embodiment of the automatic-operative shroud member 40. Various elements or parts for assembling the automatic-operative shroud member 40 are illustrated in FIGS. 12–21C and include the following: arm(s) 60; support pin(s) 71; and support bushing(s) 80. As best shown in FIGS. 12 and 13, the automatic-operative shroud member 40 includes a pair of opposed bores 85*a* and 85*b* for respectively rotatably receiving threaded ends of a pair of support pins 71 and 71 (see FIGS. 16 and 17). For this preferred embodiment of the invention, one of the shroud members 40 is pivotally disposed in a grid space (e.g., grid spaces 28*b*, 29*b*, etc.) between contiguously spaced grid bars (e.g., pairs of spaced grid bars 28*a* and 28*b*, 28*b* and 28*c*, etc.). As best shown in FIGS. 9A and 9B, shroud members 40*a*, 40*b*, 40*c* and 40*d* are pivotally supported by the frame assembly 13 and are respectively pivotally disposed in the grid spaces 29*a*, 29*b*, 29*c* and 29*d* between respective pairs of grid bars 28*a* and 28*b*, 28*b* and 28*c*, 28*c* and 28*d*, and 28*d* and 28*e*. In FIG. 9B there is seen shroud members 40*a* and 40*b* in an open position and shroud members 40*c* and 40*d* in a closed position. With shroud members 40*c* and 40*d* in an open position, leading edges 31*b* and 31*c* of respective grid bars 28*b* and 28*c* are exposed. With shroud members 40*c* and 40*d* in a closed position, respective grid spaces 29*c* and 29*d* are blocked and respective leading edges 31*d* and 31*e* of spaced grid bars 28*d* and 28*e* are covered. Shroud members 40*a*, 40*b*, 40*c* and 40*d* for this preferred embodiment of the present inventions may be automatically operated by any suitable means, such as by a pneumatic cylinder assembly, generally illustrated as 50 in FIGS. 22 and 25.

The pneumatic cylinder assembly 50 includes a bracket 54 and a plurality of pneumatic cylinders 58*a*, 58*b*, 58*c* and 58*d* coupled to the bracket 54. Pneumatic cylinders 58*a*, 58*b*, 58*c* and 58*d* communicate with a pressurized-air source (not shown) and a pneumatic-cylinder control station (not shown) such that an operator may control operation of the pneumatic cylinders 58*a*, 58*b*, 58*c* and 58*d* in accordance with the required cleaning requirements for any given lot of lint cotton 25. Pneumatic cylinders 58*a*, 58*b*, 58*c* and 58*d* are respectively coupled to arms 60*a*, 60*b*, 60*c* and 60*d* via respective clevis assemblies 64*a*, 64*b*, 64*c* and 64*d*. Clevis assemblies 64*a*, 64*b*, 64*c* and 64*d* respectively include clevis members 66*a*, 66*b*, 66*c* and 66*d* which couple to arms 60*a*, 60*b*, 60*c* and 60*d*, respectively, through the assistance of respective pins 68*a*, 68*b*, 68*c* and 68*d* (see FIG. 23). Clevis members 66*a*, 66*b*, 66*c* and 66*d* are respectively connected to cylinder rods 70*a*, 70*b*, 70*c* and 70*d* of the respective pneumatic cylinders 58*a*, 58*b*, 58*c* and 58*d*.

Arms 60*a*, 60*b*, 60*c* and 60*d* connect to respective support pins 71*a*, 71*b*, 71*c* and 71*d*, which threadably engage shroud members 40*a,* 40*b,* 40*c* and 40*d,* respectively. Arms 60*a,* 60*b,* 60*c* and 60*d* may connect to the respective support pins 71*a,* 71*b,* 71*c,* and 71*d* in any suitable manner. By way of example only in employing arm 60*a* of FIGS. 21A–21D and support pin 71*a* of FIGS. 16 and 17 for exemplarily describing an arm-support pin connection, arm 60*a* is seen in FIGS. 21A–21D as possessing a generally cylindrical recess 73*a* and an opening 75*a* wherethrough pin 68*a* passes for coupling arm 60*a* to clevis member 66*a*. Arm 60*a* has an arm ridge or tongue 77*a* disposed in the cylindrical recess 73*a*. Support pin 71*a* is formed with a generally longitudinal slot 79*a*. The threaded end of support pin 71*a* is screwed into threaded bore 85*b* of a shroud member 40, and the end of the support pin 71*a* with the longitudinal slot 79*a* is inserted into the cylindrical recess 73*a* such that arm tongue 77*a* of arm 60*a* slides into the longitudinal slot 79*a* of support pin 71*a*. With arm tongue 77*a* lodged in the longitudinal slot 79*a,* arm 60*a* is keyed and affixed to support pin 71*a*. While arm 60*a* has been described as having cylindrical recess 73*a,* opening 75*a,* and arm tongue 77*a,* it is to be understood that arms 60*b,* 60*c,* and 60*d* would each also possess a similar cylindrical recess, a similar opening, and a similar arm tongue. Also, while support pin 71*a* has been described as having longitudinal slot 79*a,* it is to be understood that support pins 71*b,* 71*c* and 71*d* would each have a longitudinal slot which would be similar to longitudinal slot 79*a*. Respective arm tongues of arms 60*b,* 60*c* and 60*d* would slide into respective longitudinal slots of support pins 71*b,* 71*c* and 71*d* for keying or affixing arms 60*b,* 60*c* and 60*d* to respective support pins 71*b,* 71*c* and 71*d*.

Figure 26A:
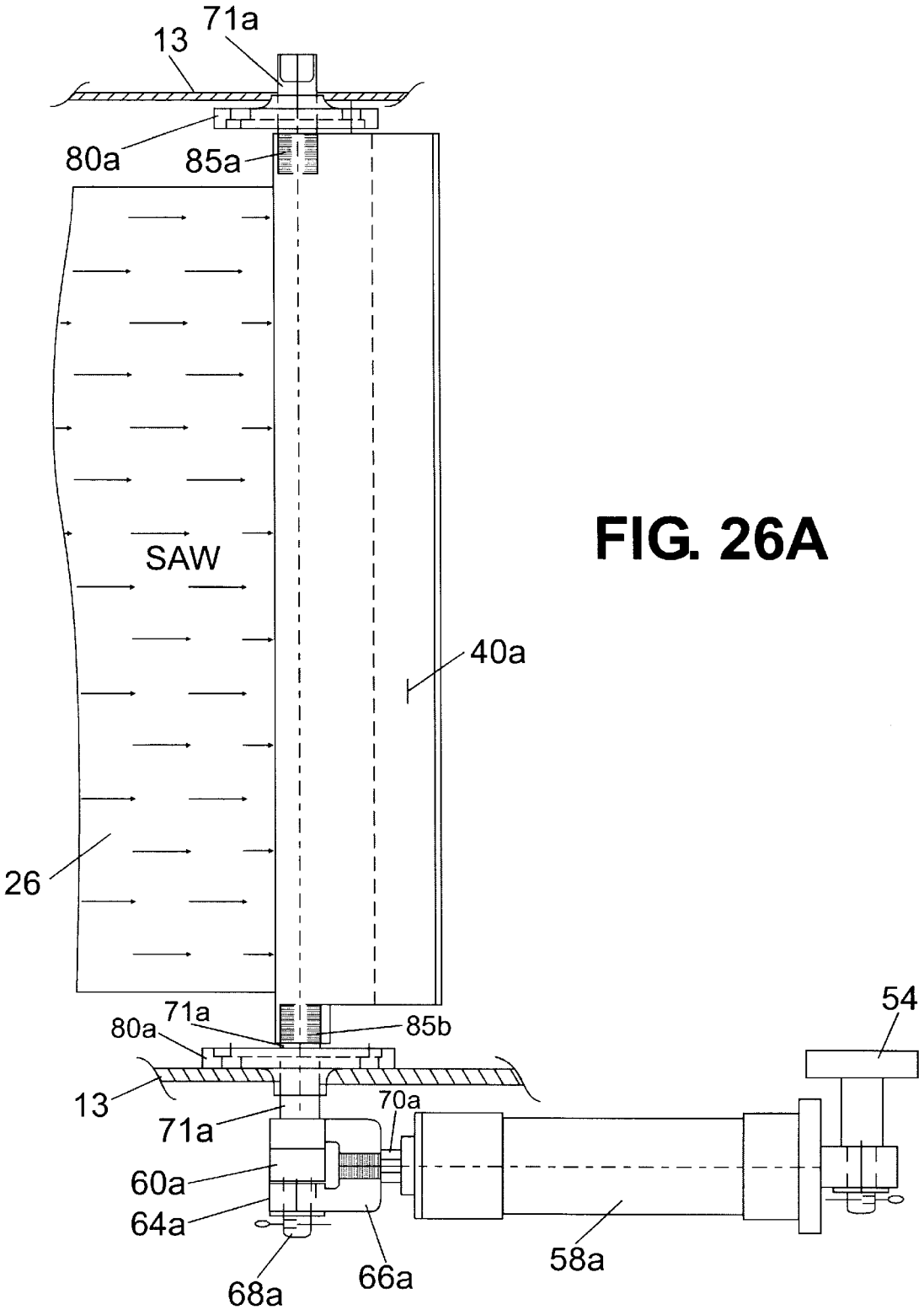
FIG. 26A is a top plan view of one of the cylinders associated with the cylinder assembly of FIG. 25, wherein the shown cylinder is coupled to a shroud member.
Figure 26B:
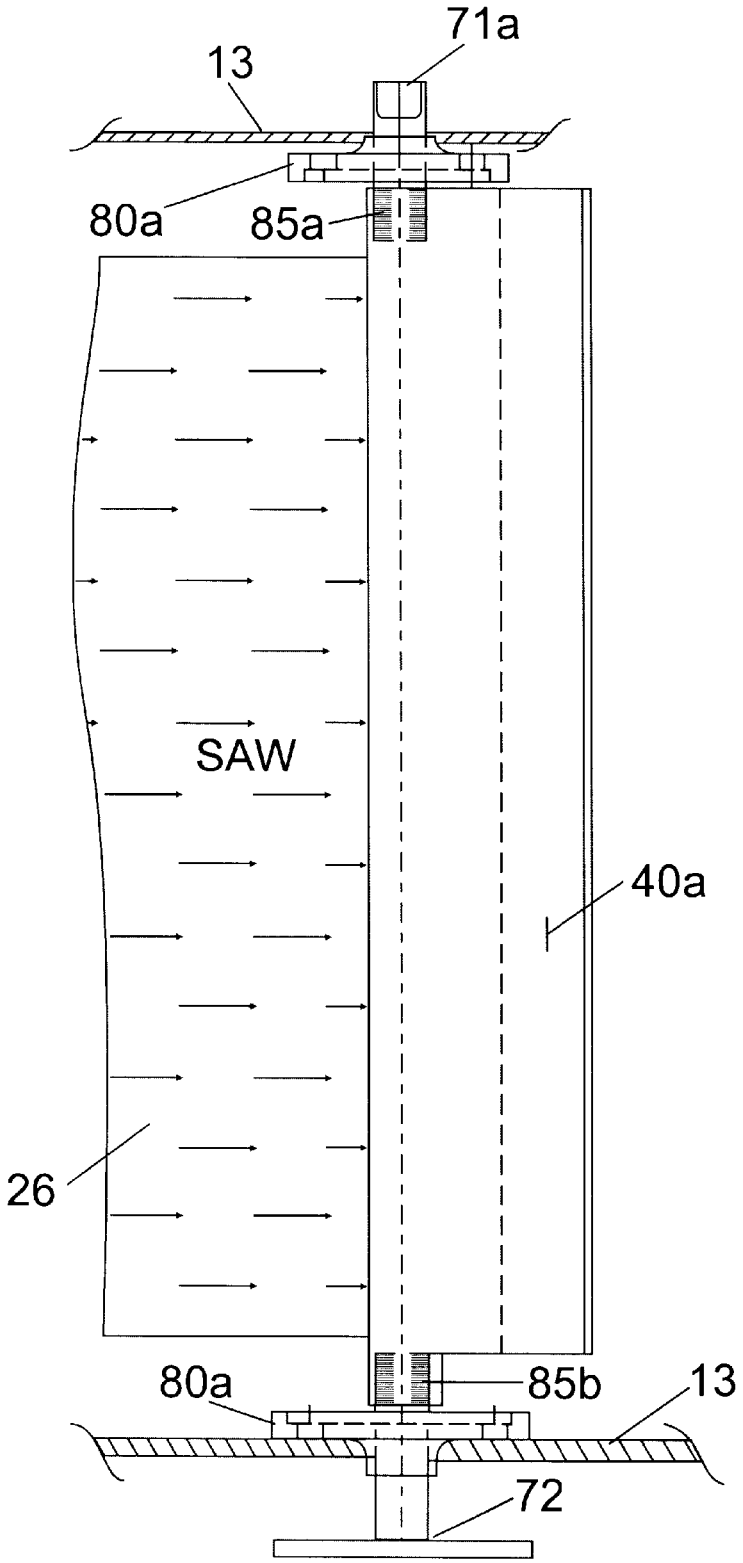
FIG. 26B is a top plan view of the shroud member in FIG. 26A coupled to the T-shaped support pin of FIG. 20A.
Figure 27:
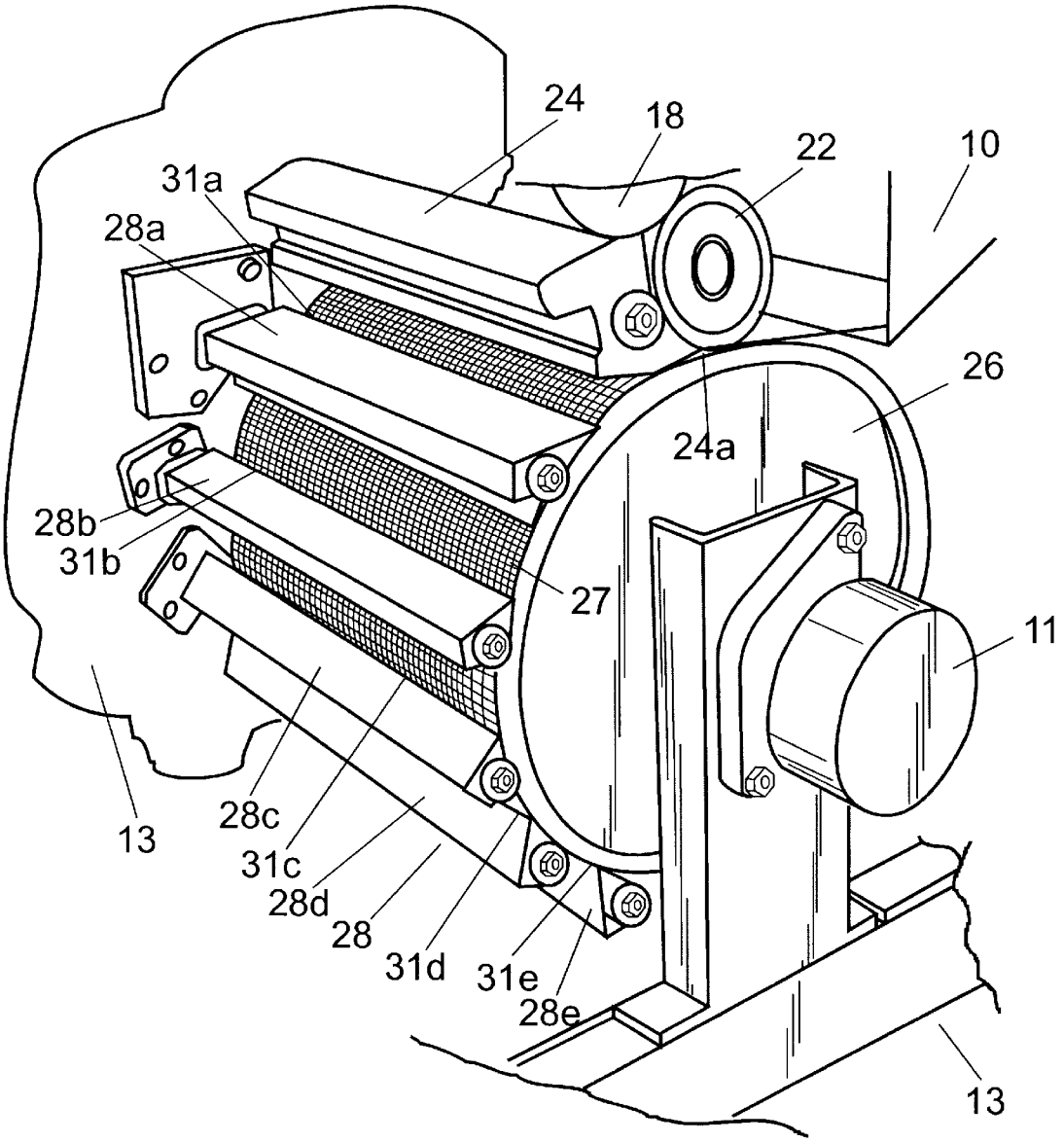
FIG. 27 is a perspective view of a prior art saw cylinder and a grid assembly having a plurality of grid bars.

In another embodiment of the present invention, a T-shaped support pin, such as T-shaped support pin generally illustrated as 72 in FIGS. 20A, 20B and 26B, may replace one of the support pins, such as support pin 70*a,* and be coupled to one of the shroud members 40, such as shroud member 40*a* in FIG. 26B, in order that the associated shroud member 40 may be manually pivoted. The T-shaped support pin 72 would be supported by a support bushing (identified as "80" below) which is secured to the frame assembly 13. This procedure changes an automatic-operative pivotal shroud member 40 into a manually-operative pivotal shroud member 40.

Pairs of support pins 71*a*—71*a,* 71*b*—71*b,* 71*c*—71*c* and 71*d*—71*d* threadably engage the threaded bores 85*a*–85*b* of respective shroud members 40*a,* 40*b,* 40*c* and 40*d*. The support bushings 80 are secured to the frame assembly 13 such as to remain stationarily affixed thereto. The support pins 71 slidably and rotatably pass through the support bushings 80 such as to be capable for rotating within the support bushings 80. One of the arms 60 is coupled to one of the support pins 71 in accordance with the previously mentioned procedure such that when arm 60 is pivotally moved by one of pneumatic cylinders (e.g., 58*a,* 58*b,* etc), the associated shroud member 40 pivotally moves correspondingly. By way of illustration only, there is seen in FIG. 26A support pins 71*a* and 71*a,* respectively, threadably connecting to threaded bores 85*a* and 85*b* of shroud member 40. The shown support bushings 80*a* and 80*a* are connected to the frame assembly 13. Pins 71*a* and 71*a* rotatably pass through support bushings 80*a* and 80*a,* respectively, such that shroud member 40*a* pivotally swings on the support bushings 80*a* and 80*a*. One of the pins 71*a* is keyed to arm 60*a* in accordance with the previously described procedure. When pneumatic cylinder 58*a* pivotally moves arm 60*a* in a desired direction, the shroud member 40*a* pivotally moves in the same desired direction. More specifically, when pneumatic cylinder 58*a* pivotally moves arm 60*a* in direction of the arrow A in FIG. 25, shroud member 40*a* is pivotally moved into a closed position. In FIG. 26B the T-shaped support pin 72 as rotatably supported by support bushing 80*a*. When T-shaped support pin 72 is manually grasped and rotated in a desired direction, shroud member 40*a* pivotally moves in the identical desired direction.

Figure 10:
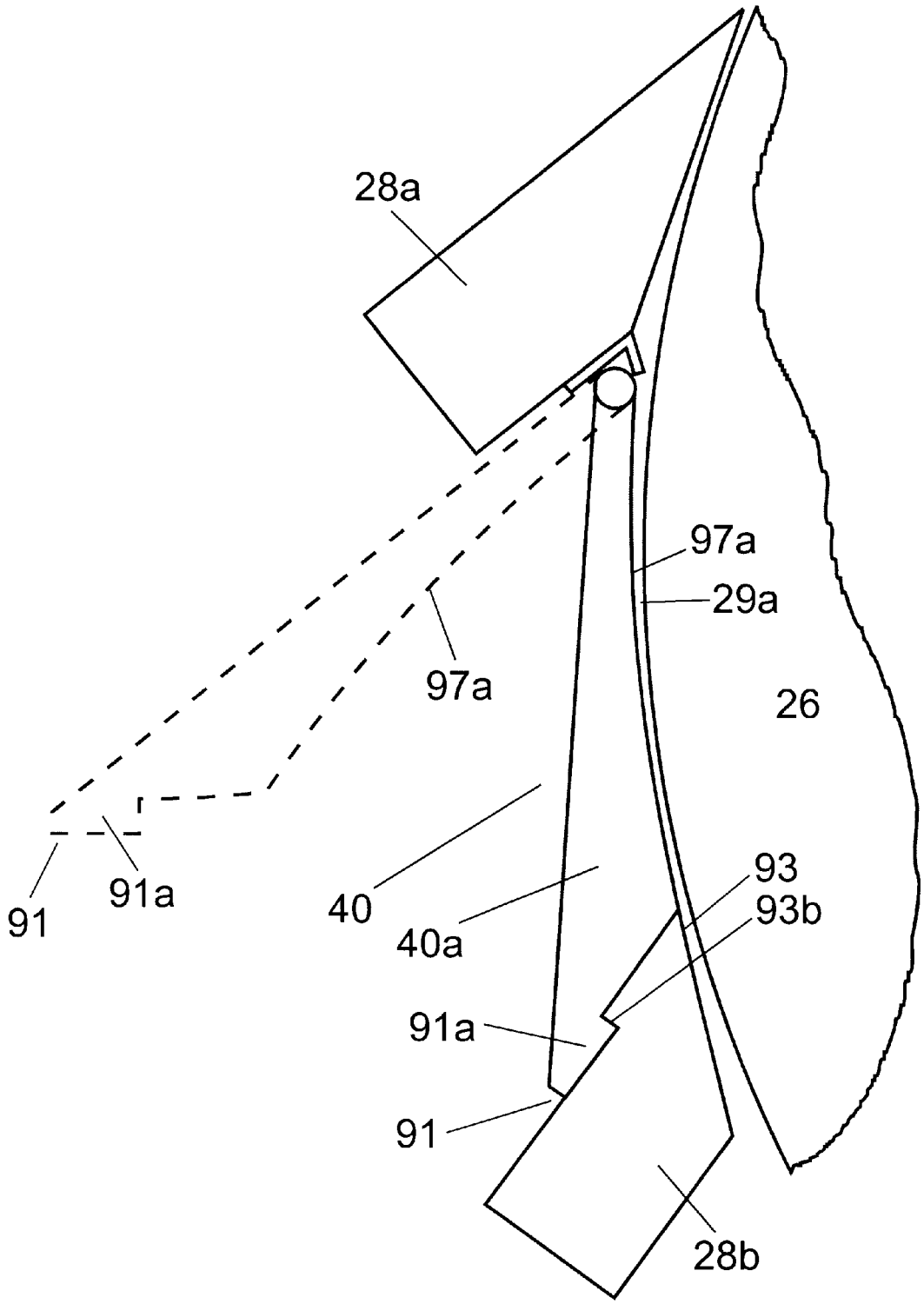
FIG. 10 is an enlarged end elevational view of two grid bars having a grid space therebetween and a shroud member pivotally disposed within the grid space for removing the cleaning ability of a cleaning edge of one of the grid bars.
Figure 11:
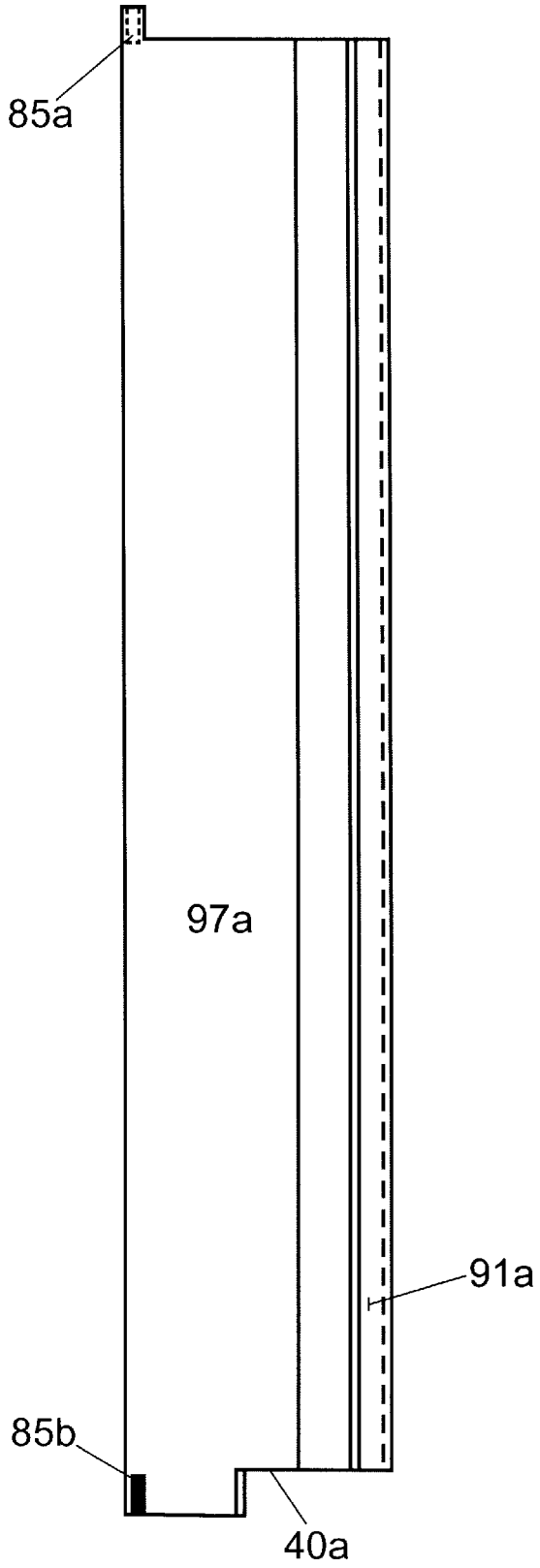
FIG. 11 is a front elevational view of the shroud member of FIG. 10.
Figure 22:
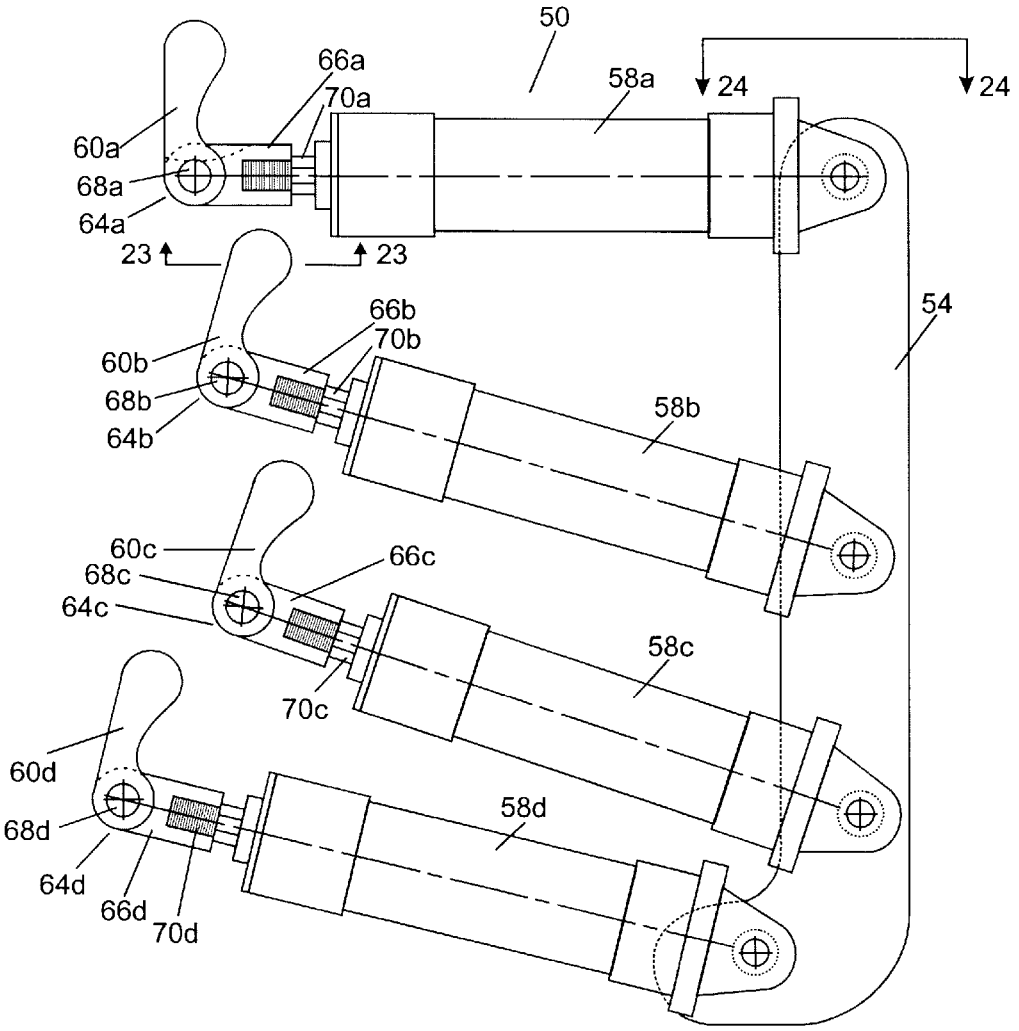
FIG. 22 is a side elevational view of a cylinder assembly having a plurality of pneumatic cylinders supported by a bracket, with each pneumatic cylinder coupled to an arm for pivotally moving the shroud member associated with the arm.
Figure 23:
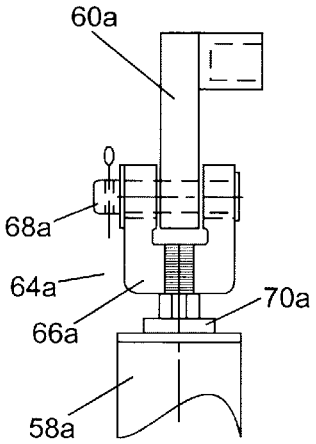
FIG. 23 is a bottom plan view taken in direction of the arrows and along the plane of line 23—23 in FIG. 22.
Figure 24:
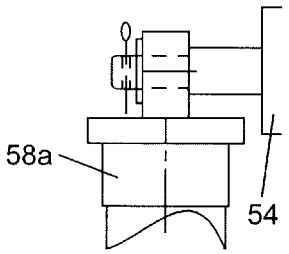
FIG. 24 is a top plan view taken in direction of the arrows along the plane of line 24—24 in FIG. 22.
Figure 25:
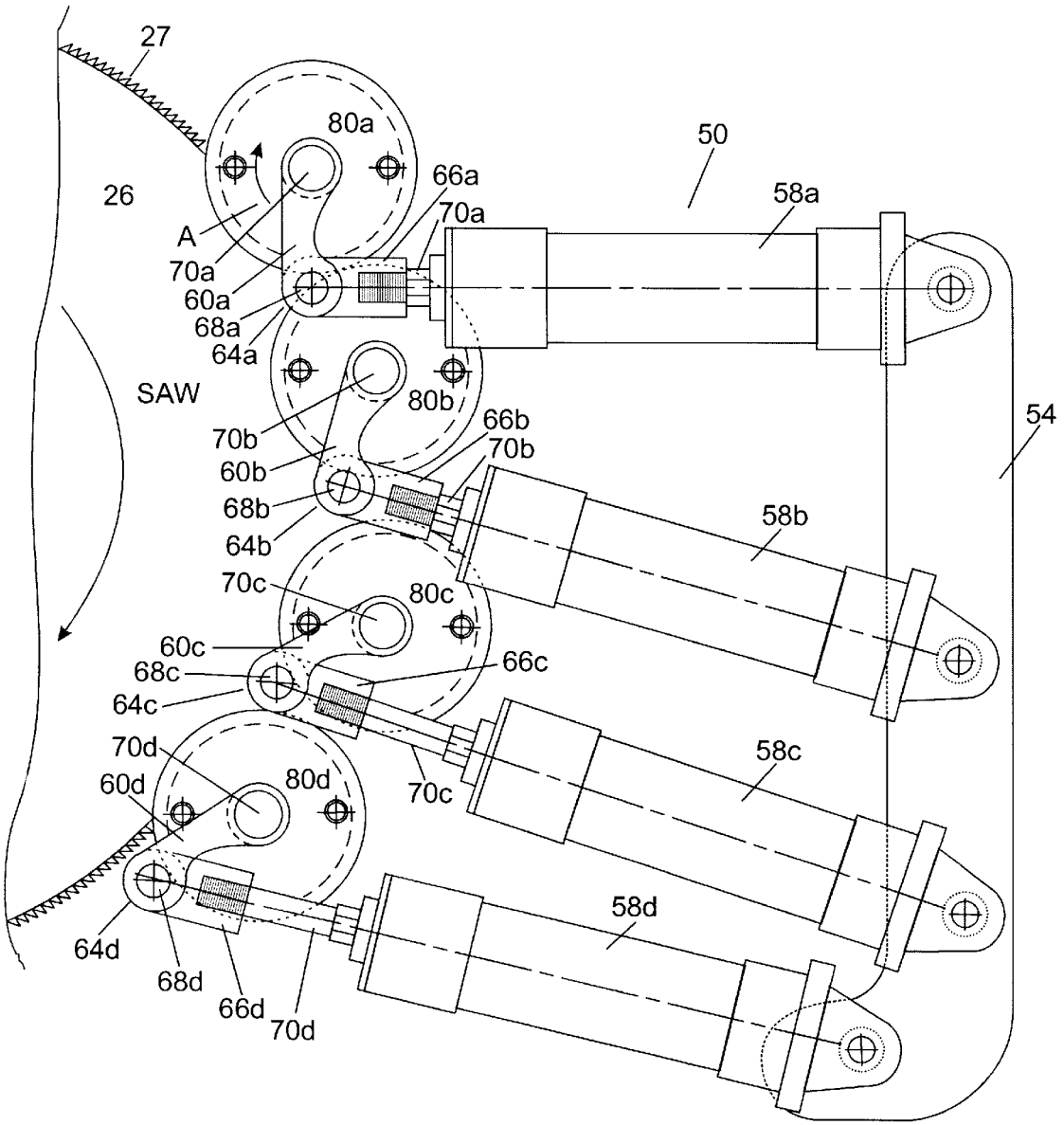
FIG. 25 is a side elevational view of the cylinder assembly of FIG. 22 in proximity to a saw cylinder and illustrating support bushings coupled to the arms which pivotally move the associated shroud members.

Referring now to FIGS. 10 and 11, there is seen another embodiment for the automatic-operated shroud member 40 wherein a shroud lug or tongue 91 is integrally associated with the shroud member 40, and a grid shoulder 93 is integrally associated with certain of the grid bars (e.g., grid bars 28*b,* 28*c,* etc.). By way of illustration only, there is seen in FIGS. 10 and 11, shroud member 40*a* having a shroud lug or tongue 91*a,* and grid bar 28*b* having a grid shoulder 93*b*. Shroud member 40*a* also has an arcuate surface 97*a* which is generally arcuately aligned with the grid bar 28*b* when shroud member 40*a* is in a closed position. When shroud member 40*a* is also in a closed position, the shroud tongue 91*a* of shroud member 40*a* rests on the grid bar 28*b* and the shroud tongue 91*a* is generally aligned with the grid shoulder 93*b* of the grid bar 28*b,* as best shown in FIG. 10. While shroud member 40*a* and grid shoulder 28*b* have been used to illustrate this additional preferred embodiment for the automatic-operative shroud member 40, it is to be understood that pivotally disposed shroud members 40*b,* 40*c,* and 40*d* may also include a shroud tongue, such as shroud tongue 91*a,* and grid bars 28*c,* 28*d* and 28*e* may also possess a grid shoulder, such as grid shoulder 93*b*.

Figure 28:
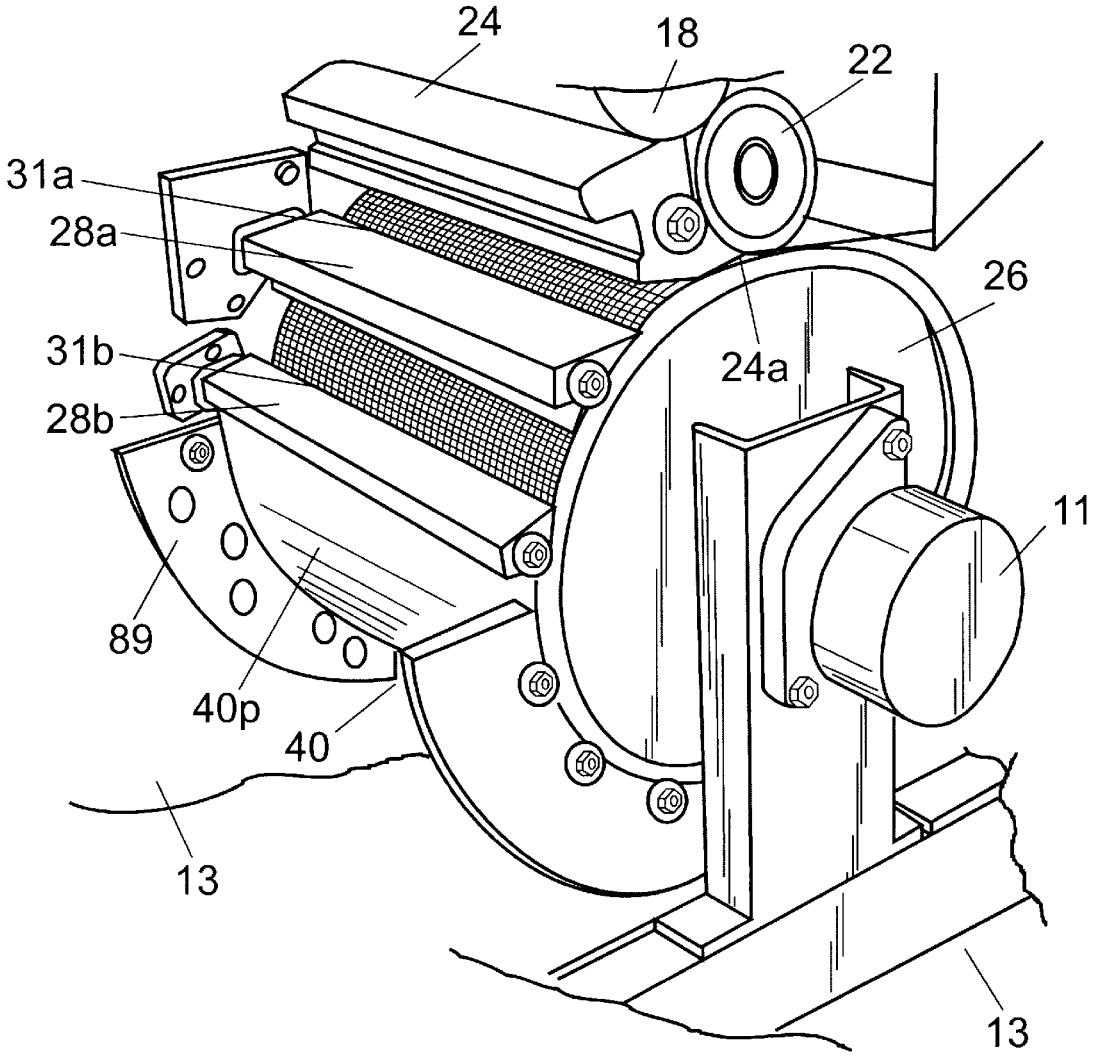
FIG. 28 is a perspective view of the saw cylinder and grid assembly of FIG. 27 after three of the grid bars were removed and replaced by another embodiment of the shroud member.
Figures 29, 30:
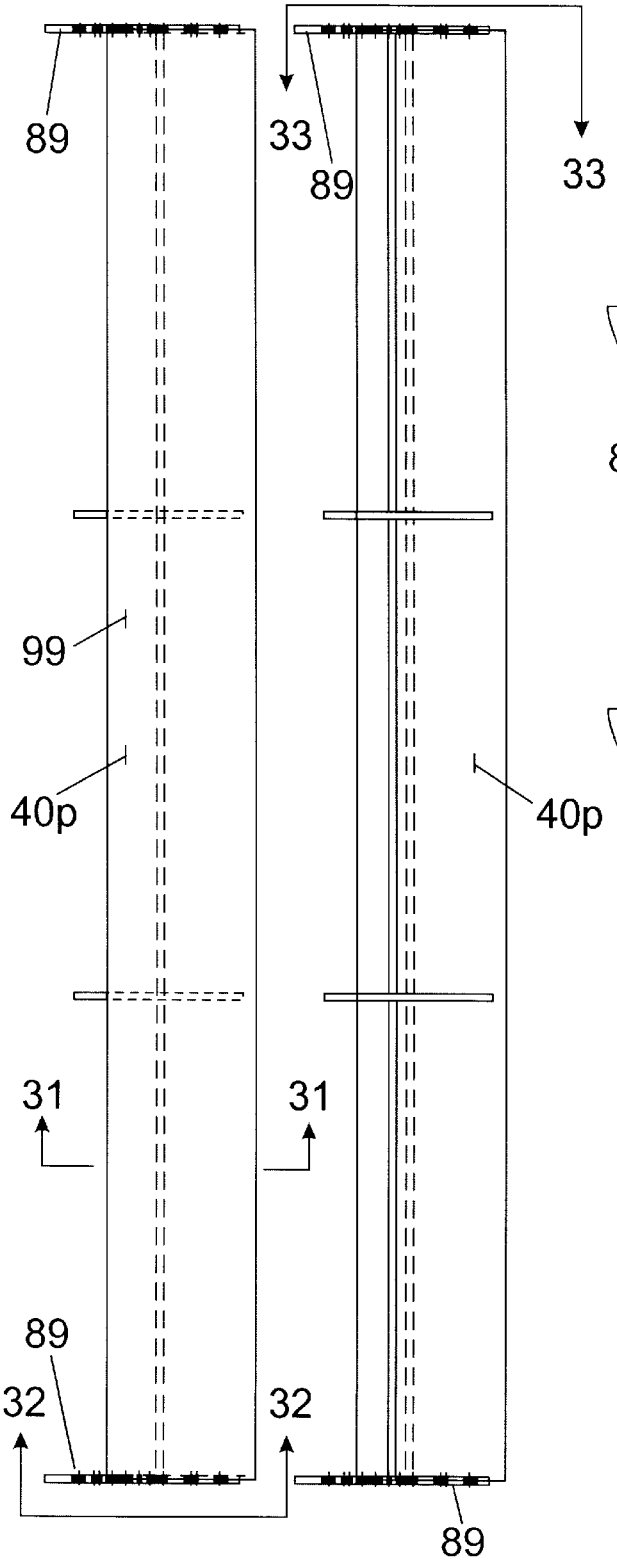
FIG. 29 is a front elevational view of another embodiment of the shroud member.
FIG. 30 is a rear elevational view of the shroud member of FIG. 29.
Figure 33:
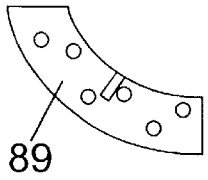
FIG. 33 is an end elevational view of the shroud member in FIG. 30 taken in direction of the arrows and along the plane of line 33—33 in FIG. 30.
Figure 32:
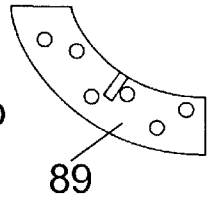
FIG. 32 is an end elevational view of the shroud member of FIG. 29 taken in direction of the arrows and along the plane of line 32—32 in FIG. 29.
Figure 31:
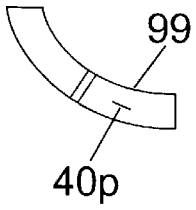
FIG. 31 is a vertical sectional view taken in direction of the arrows and along the plane of line 31—31 in FIG. 29.

Referring now to FIGS. 27–33, there is seen the preferred embodiment of the manually positioned shroud member 40. For this preferred embodiment of the invention, the shroud member 40 includes a shroud plate 40*p,* preferably a generally arcuate shroud plate 40*p,* having an arcuate surface 99 (see FIG. 31) which is generally arcuately aligned with the grid bars, such as grid bars 28*a* and 28*b* as shown in FIG. 28. Integrally bound to shroud plate 40*p* is a pair of shroud flanges 89 and 89, preferably a pair of generally arcuate shroud flanges 89 and 89 as best shown in FIG. 28, both of which connect to the frame assembly 13 to support the shroud plate 40*p* in close proximity to the toothed wire 27 of the saw cylinder 26. For this preferred embodiment of the shroud member 40, a prior art lint cleaner 10, such as prior art lint cleaner 10 in FIGS. 1–4, may be retrofitted with this preferred embodiment of the shroud member 40 to modify the lint-cleaning ability of the lint cleaner 10. Retrofitting is accomplished by replacing one or more of the grid bars (e.g., grid bars 28*b,* 28*c,* etc.) with this preferred embodiment of the shroud member 40 (i.e., the shroud plate 40*p*). By way of illustration only, this is seen grid bars 28*c,* 28*d* and 28*e* from the grid assembly 28 of the prior art lint cleaner 10 in FIG. 27 as having been removed and replaced with the shroud plate 40*p*. Thus, by replacing grid bars 28*c,* 28*d* and 28*e* with the shroud plate 40*p,* leading edges 31*c,* 31*d* and 31*d* have been removed so that any lint cotton 25 engaged to the toothed wire 27 is not over cleaned, producing the concomitant loss lint cotton 25*a*.

Any of the preferred embodiments of the shroud member 40 may be placed or situated such as to cover the leading edge of the initial grid bar in the grid assembly 28. For example and as best shown in FIG. 9B, there is seen the shroud member 40 in a dashed-line representation and suitably disposed before grid bar 28*a* of the grid assembly 28 such as to cover the leading edge 31*a* of grid bar 28*a*. The dashed-line represented shroud member 40 is more specifically shown in FIG. 9B as being suitably disposed between the grid bar 28*a* and the feed plate 24 such as to cover and/or contact the leading edge 31*a* of grid bar 28*a*. While the dashed-line represented shroud member 40 may possess any of the previously described preferred embodiments (e.g. the manually positioned shroud member 40 of FIGS. 27–30, etc.) for the shroud member 40, it is preferably any one of the automatic operative shroud members 40 as illustrated in FIGS. 9A–26.

In operation of the present invention, there is broadly provided a method of controlling and/or reducing the loss of loss lint cotton 25*a*. Contaminated lint cotton 25 is seized by the toothed wire 27 of a revolving saw cylinder 26 in accordance with previously described procedure. As saw cylinder 26 is revolved or rotated by motor 11, contaminated lint cotton 25 is capable of impactly contacting a leading edge (e.g., leading edges 31*a*, 31*b*, 31*c*, etc.) of each grid bar (e.g., grid bars 28*a*, 28*b*, 28*c*, etc.) for assisting in the cleaning of the contaminated lint cotton 25 and causing cotton fiber (i.e., loss lint cotton 25*a*) to separate from the contaminated lint cotton 25 and pass through the grid space (e.g., grid spaces 29*a*, 29*b*, etc.) between any two contiguous spaced grid bars (e.g., grid bars 28*a* and 28*b*, 28*b*, and 28*c*, 28*c* and 28*d*, etc), or pass through the grid space situated before an initial grid bar, such as the grid space between grid bar 28*a* and feed plate 24 (see FIG. 9B). If the contaminated lint cotton 25 which is engaged to the toothed wire 27 of the saw cylinder 26 is prevented from contacting one or more leading edges (e.g., leading edges 31*a*, 31*b*, 31*c*, etc.) of one or more grid bars (e.g., grid bars 28*a*, 28*b*, 28*c*, etc.), the quantity of loss lint cotton 25*a* separating and leaving the contaminated lint cotton 25 would be reduced.

Preventing the contaminated lint cotton 25 from contacting one or more leading edges (e.g., leading edges 31*a*, 31*b*, 31*c*, etc.) may be accomplished by any one of the following steps: (i) covering one or more leading edges (e.g., leading edges 31*a*, 31*b*, 31*c*, etc.) of one or more of the spaced grid bars (e.g., grid bars 28*a*, 28*b*, 28*c*, etc.); (ii) contacting one or more leading edges (e.g., leading edges 31*a*, 31*b*, 31*c*, etc.) of one or more of the spaced grid bars (e.g., grid bars 28*a*, 28*b*, 28*c*, etc.) with a shroud member 40; (iii) disposing a shroud member 40 in the grid space (e.g., grid space 29*a*, 29*b*, etc.) juxtaposed to one or more leading edges (e.g., leading edges 31*a*, 31*b*, 31*c*, etc.) of one or more of the spaced grid bars (e.g., grid bars 28*a*, 28*b*, 28*c*, etc.); (iv) pivoting a shroud member 40 in the grid space (e.g., grid space 29*a*, 29*b*, etc.) juxtaposed to one or more leading edges (e.g., leading edges 31*a*, 31*b*, 31*c*, etc.) of one or more of the spaced grid bars (e.g., grid bars 28*a*, 28*b*, 28*c*, etc.); or (v) modifying the lint-cleaning ability of a lint cleaner 10 by replacing one or more grid bars (e.g., grid bars 28*a*, 28*b*, 28*c*, 28*d*, etc.) with a shroud member 40, such as shroud plate 40*p*.

Therefore, the invention(s) described herein modifies conventional saw-type lint cleaners (e.g. lint cleaner 10) to allow each grid bar (e.g., grid bars 28*a*, 28*b*, 28*c*, etc) to be selectively chosen or not chosen, thereby creating an option of having cleaning resulting from one grid bar or as many as eight grid bars in conventional saw-type lint cleaners. The invention(s) takes a conventional saw-type lint cleaner and incorporates the ability to bypass each of the grid bars using manual, semi-automated or automated methods. In the automated method where grid bars can be selected in a virtually instantaneous manner, the automatic-operative shroud member 40*d* of FIGS. 9A–26 is fitted between existing grid bars in such a manner that the cleaning point or leading edge (e.g., leading edges 31*a*, 31*b*, 31*c*, etc) of one of the grid bars is effectively removed from action. The automatic-operative shroud member 40 may be operated pneumatically, mechanically, or by some other means to rotate it from an open position to a closed position and vice-versa. In the open position, the lint cleaner grid bar functions as it normally does and cleans and blends the lint cotton 25. When the automatic-operative shroud member 40 of FIGS. 9A–26 is in the closed position, the cleaning point of the grid bar is no longer available for the lint cotton 25 as it is forced between the grid bar and the toothed wire 27 of the saw cylinder 26; thus, no cleaning or fiber damage occurs.

The automatic-operative shroud member 40 of FIGS. 9A–26 is preferably used in coordination with an automated assessment of the color and foreign matter content in the contaminated lint cotton 25 as provided in U.S. patent application Ser. No. 08/691,069, incorporated herein by reference thereto. However, the automatic-operative version can be used based upon manual assessment of the cleaning requirements for the contaminated lint 25. This typically would be done by an initial assessment of the raw material as it is positioned to be fed into the ginning system. For example, in the United States much of the cotton is delivered to the gin system in a free standing module that contains 12 to 20 bales of seed cotton weighing about 1,500 pounds each for spindle-harvested cotton and about 2,000 pounds each for stripper-harvested cotton and about 1,300 each for manually harvested cotton. One skilled in the art can make visual assessments of the foreign matter levels and color in the raw product in the module and generally determine the amount of lint cleaning required. Samples of the raw material (seed cotton) can also be collected from the module and evaluated with traditional laboratory instruments to assess the color and foreign matter of the contaminated lint cotton 25. Armed with this knowledge along with the knowledge of the cleanability of the particular variety of contaminated lint cotton 25, one skilled in the art can assess the amount of cleaning required for the module. Obviously, modules that require the same levels of cleaning should be grouped together to minimize the number of times that the cleaning sequence should be changed.

Thus, while the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

What is claimed is:

1. An apparatus for cleaning cotton comprising:

a frame;

a cylinder member rotatably supported by the frame and having a cylindrical surface supporting a fiber-engaging structure;

a motor coupled to the cylinder member;

a grid assembly connected to the frame for assisting in the removal of undesirable particulates from cotton engaged to the fiber-engaging structure of the cylinder member, said grid assembly including a plurality of grid bars connected to the frame in a spatial relationship such that any two contiguous grid bars are separated by a grid space; and a shroud member supported by the frame for controlling the loss of cotton through the grid space between contiguous grid bars.

2. The apparatus of claim 1 wherein said shroud member is pivotally supported by the frame in the grid space between said contiguous grid bars such as to be capable of covering and opening the grid space for controlling the loss of cotton.

3. The apparatus of claim 1 wherein said shroud member includes a generally arcuate surface.

4. The apparatus of claim 3 wherein said generally arcuate surface of said shroud member is generally arcuately aligned with said plurality of grid bars.

5. The apparatus of claim 1 wherein each of said contiguous grid bars has a cleaning edge for contacting cotton engaged to the fiber-engaging structure of the cylinder member; and said shroud member covers the cleaning edge of one of said contiguous grid bars to prevent the cleaning edge from contacting the cotton engaged to the fiber-engaging structure of the cylinder member.

6. The apparatus of claim 1 wherein said cylinder member comprises a saw cylinder and said fiber-engaging structure includes saw teeth.

7. The apparatus of claim 2 wherein one of said contiguous grid bars includes a grid shoulder, and said shroud member comprises a shroud tongue that is capable of being removably aligned with said grid shoulder.

8. An apparatus for cleaning cotton comprising:

a frame;

a cylinder member rotatably supported by the frame and having a cylindrical surface supporting a fiber-engaging structure;

a motor coupled to the cylinder member;

a grid assembly connected to the frame for assisting in the removal of undesirable particulates from cotton engaged to the fiber-engaging structure of the cylinder member, said grid assembly including at least one grid bar connected to the frame; and a shroud member supported by the frame and generally aligned with the grid bar for controlling the loss of cotton.

9. The apparatus of claim 8 wherein said shroud member includes a generally arcuate surface.

10. The apparatus of claim 9 wherein said generally arcuate surface of said shroud member is generally arcuately aligned with the grid bar.

11. The apparatus of claim 10 wherein said cylinder member comprises a saw cylinder and said fiber-engaging structure includes saw teeth.

12. The apparatus of claim 8 wherein said grid bar includes a grid shoulder, and said shroud member comprises a shroud tongue generally aligned with said grid shoulder.

13. A saw lint cleaner for cleaning cotton comprising:

a frame;

a saw cylinder rotatably supported by the frame and having saw teeth for seizing cotton;

a motor coupled to the saw cylinder;

a grid assembly connected to the frame for assisting in the removal of undesirable particulates from cotton engaged to the saw teeth of the saw cylinder, said grid assembly including a plurality of grid bars connected to the frame in a spatial relationship such that any two contiguous grid bars are separated by a grid space; and a shroud member supported by the frame for controlling the loss of cotton through the grid space between contiguous grid bars.

14. The saw lint cleaner of claim 13 wherein said shroud member is pivotally supported by the frame in the grid space between said contiguous grid bars such as to be capable of covering and opening the grid space for controlling the loss of cotton.

15. The saw lint cleaner of claim 13 wherein said shroud member includes a generally arcuate surface.

16. The saw lint cleaner of claim 15 wherein said generally arcuate surface of said shroud member is generally arcuately aligned with said plurality of grid bars.

17. The saw lint cleaner of claim 13 wherein each of said contiguous grid bars has a cleaning edge for contacting cotton engaged to the saw teeth of the saw cylinder; and said shroud member covers the cleaning edge of one of said contiguous grid bars to prevent the cleaning edge from contacting the cotton engaged to the saw teeth of the saw cylinder.

18. The saw lint cleaner of claim 14 wherein one of said contiguous grid bars includes a grid shoulder, and said shroud member comprises a shroud tongue that is capable of being removably aligned with said grid shoulder.

19. A method of controlling the loss of cotton during lint cleaning of contaminated cotton comprising the steps of:

(a) providing a grid assembly including a plurality of spaced grid bars wherein any two contiguous spaced grid bars are separated by a grid space;

(b) seizing contaminated cotton with a fiber-engaging structure of a cylinder member disposed in proximity to said grid assembly of step (a);

(c) revolving the cylinder member of step (b) such that said contaminated cotton is capable of impactly contacting a cotton-cleaning structure of each grid bar for assisting in the cleaning of the contaminated cotton and causing cotton fiber to separate from the contaminated cotton; and (d) preventing said contaminated cotton from impactly contacting said cotton-cleaning structure of one of said spaced grid bars for reducing the amount of cotton fiber separating from the contaminated cotton.

20. The method of claim 19 wherein said preventing step (d) comprises covering said cotton-cleaning structure of step (d).

21. The method of claim 19 wherein said preventing step (d) comprises contacting said cotton-cleaning structure of step (d) with a shroud member.

22. The method of claim 19 wherein said preventing step (d) comprises disposing a shroud member in the grid space juxtaposed to said cotton-cleaning structure of step (d).

23. The method of claim 19 wherein said preventing step (d) comprises pivoting a shroud member in the grid space juxtaposed to said cotton-cleaning structure of step (d).

24. The method of claim 23 additionally comprising removably aligning a grid shoulder of one of the grid bars with a shroud tongue of said shroud member.

25. A method for reducing the loss of cotton fiber during lint cleaning of contaminated cotton comprising the steps of:

(a) providing a grid assembly including a plurality of spaced grid bars wherein each spaced grid bar has a cleaning edge for impactly contacting contaminated cotton;

(b) engaging contaminated cotton with a fiber-engaging structure of a cylinder member disposed in proximity to said grid assembly of step (a);

(c) revolving the cylinder member of step (b) such that said engaged contaminated cotton impactly contacts the cleaning edges of said spaced grid bars for lint cleaning the contaminated cotton and causing cotton fiber to separate from the contaminated cotton; and (d) covering the cleaning edge of at least one grid bar for reducing the quantity of cotton fiber separating from the contaminated cotton.

26. A method for modifying the lint-cleaning ability of a lint cleaner comprising the steps of:

(a) providing a cotton-engaging cylinder member rotatably disposed in proximity to a grid assembly having a plurality of spaced grid bars wherein each grid bar is a cleaning point for cotton revolvably engaged to the cotton-engaging cylinder member; and (b) replacing at least one of the spaced grid bars with a shroud member in order to remove at least one of the cleaning points for the cotton of step (a).

* * * * *